US006808565B1

(12) United States Patent
Koyama et al.

(10) Patent No.: US 6,808,565 B1
(45) Date of Patent: Oct. 26, 2004

(54) CLUTCH MECHANISM OF COAT FILM TRANSFER TOOL AND COAT FILM TRANSFER TOOL

(75) Inventors: Kouhei Koyama, Osaka (JP); Shigeru Tamai, Ikeda (JP); Masatoshi Shintani, Sanda (JP)

(73) Assignee: Seed Rubber Co., Ltd., Osaka (JP)

( * ) Notice: Subject to any disclaimer, the term of this patent is extended or adjusted under 35 U.S.C. 154(b) by 0 days.

(21) Appl. No.: 09/605,056

(22) Filed: Jun. 28, 2000

Related U.S. Application Data

(63) Continuation of application No. 08/726,175, filed on Oct. 4, 1996, now abandoned.

(30) Foreign Application Priority Data

Oct. 6, 1995 (JP) ..... 7-286573
Oct. 6, 1995 (JP) ..... 7-286574

(51) Int. Cl.[7] ..... B05C 1/00

(52) U.S. Cl. ..... 118/200; 118/257; 242/538.1; 242/538.3; 156/577; 156/579

(58) Field of Search ..... 118/200, 257; 400/695, 696, 700; 156/577, 579; 242/538.1, 538.3

(56) References Cited

U.S. PATENT DOCUMENTS

| | | | | |
|---|---|---|---|---|
| 4,718,971 A | * | 1/1988 | Summers | |
| 4,851,076 A | | 7/1989 | Manusch et al. | 156/577 |
| 4,891,090 A | | 1/1990 | Lorincz et al. | 156/577 |
| 5,006,184 A | | 4/1991 | Manusch et al. | 156/579 |
| 5,125,589 A | | 6/1992 | Manusch | 156/577 |
| 5,297,879 A | | 3/1994 | Oikawa | 242/538.3 |
| 5,310,437 A | | 5/1994 | Tucker | 156/577 |
| 5,310,445 A | * | 5/1994 | Tucker | |
| 5,379,477 A | | 1/1995 | Tamai et al. | 118/257 |
| 5,430,904 A | | 7/1995 | Ono et al. | 15/104 |
| 5,472,560 A | | 12/1995 | Horng | 156/577 |
| 5,490,898 A | | 2/1996 | Koyama | 118/257 |
| 5,512,128 A | | 4/1996 | Manusch et al. | 156/577 |
| 5,556,469 A | | 9/1996 | Koyama et al. | 118/257 |
| 5,595,626 A | | 1/1997 | Yokouchi et al. | 156/577 |
| 5,679,156 A | | 10/1997 | Matsumaru | 118/200 |
| 5,685,944 A | | 11/1997 | Nose et al. | 156/577 |

FOREIGN PATENT DOCUMENTS

CN 198883 1/1993

* cited by examiner

*Primary Examiner*—Peter Chin
(74) *Attorney, Agent, or Firm*—Rader, Fishman & Grauer PLLC

(57) ABSTRACT

A clutch mechanism having an easy-to-manufacture and inexpensive constitution, by making use of frictional engaging force in thrust direction, in a coat film transfer tool of automatic winding type. At least at the feed reel side, a clutch mechanism is provided between a driven member of a tape winding portion and a drive side rotary gear for rotating and driving it, and its power transmission makes use of the frictional engaging force in thrust direction between the driven member and drive side rotary gear. This frictional engaging force can be set by properly adjusting the dimensional relation in thrust direction between the mutual constituent members, and therefore the designing and manufacturing conditions of the constituent members are less strict, manufacture is easy, assembling is easy, and hence the manufacturing cost and device cost can be lowered.

14 Claims, 22 Drawing Sheets

(a)

(b)

CLUTCH MECHANISM OF COAT FILM TRANSFER TOOL AND COAT FILM TRANSFER TOOL

This application is a continuation application filed under 37 CFR 1.53(b) of parent application Ser. No. 08/726,175, filed Oct. 4, 1996, now abandoned.

BACKGROUND OF THE INVENTION

1. Field of the Invention

The present invention relates to a clutch mechanism of a coat film transfer tool, and a coat film transfer tool comprising this clutch mechanism, and more particularly to a clutch technology for synchronizing the feed speed and take-up speed of coat film transfer tape in a feed reel and a take-up reel, in a coat film transfer tool for transferring a coat film such as corrective paint layer, adhesive layer or the like on a coat film transfer tape onto a sheet of paper or the like, and automatically collecting the coat film transfer tape after use.

2. Description of the Related Art

An example of structure of this kind of coat film transfer tool is shown in FIG. 21, and in this transfer tool, in a case (a) that can be held and manipulated by a single hand, a feed reel (c) with a coat film transfer tape (b) wound thereabout and a take-up reel (d) for collecting the coat film transfer tape (b') after use are rotatably provided, and a coat film transfer head (f) for pressing the coat film transfer tape (b) onto the object of transfer is protruding at the front end of the case (a). The both reels (c) and (d) are wound up automatically as,being linked by an interlock mechanism (g) so as to cooperate with each other. In this interlock mechanism (g), gears (h) and (i) provided on the outer circumference of the both reels (c) and (d) are engaged with each other.

When this coat film transfer tool is used as an erasing tool for correcting a wrong letter or the like, the case (a) is held by one hand, and moved in a desired direction while pressing the coat film transfer tape (b) tightly to the correction area (the object of transfer) by a pressing portion (j) of the head (f). As a result, the corrective paint layer of the coat film transfer tape (b) in the pressing portion (j) of the head (f) is applied on the correction area, and the letter is deleted, and the coat film transfer tape (b') after use is automatically wound up and collected by the take-up reel (d).

In this case, as being used, the outer diameter of the coat film transfer tape (b) on the feed reel (c) becomes smaller, while the outer diameter of the coat film transfer tape (b') on the take-up reel (d) becomes larger. On the other hand, the rotation ratio of the feed reel (c) and take-up reel (d) (corresponding to the gear ratio of the interlock mechanism (g)) is always constant. Accordingly, the take-up speed of the take-up reel (d) tends to be faster gradually as compared with the feed speed of the feed reel (c), and to prevent this, therefore, it is necessary to synchronize the feed speed and take-up speed. For this purpose, the feed reel (c) is provided with a clutch mechanism (k) for synchronizing the feed speed and take-up speed.

That is, in the feed reel (c), a boss (m) of a drive gear (h) rotatably supported on a support shaft (n), and a tape feed core (o) with the coat film transfer tape (b) wound thereabout is rotatably fitted on the boss (m), and the clutch mechanism (k) is provided between the boss (m) and the tape feed core (o).

In this clutch mechanism (k), elastically deforming clutch pawls (p), (p) provided on the outer circumference of the boss (m) are engaged with multiple stopping portions (q), (q), . . . provided in the inner circumference of the tape feed core (o), elastically.

As the take-up speed is gradually increased as compared with the feed speed, and the synchronism of the two speeds is broken to increase the torque acting on the tape feed core (o), the clutch mechanism (k) causes the tape feed core (o) to slide and rotate on the boss (m), so that the feed speed is synchronized with the take-up speed.

In suchaclutch mechanism (k), the engaging and disengaging action of the clutch pawls (p), (p) and stopping portions (q), (q), . . . is intermittently repeated elastically with a clicking sound, the manipulating hand of the user may feel discomfort, and running of the coat film transfer tape (b) may be uneven, and as the use is continued further, the engaging and disengaging action becomes more frequent as the revolution speed of the tape feed core (o) increases, and the discomfort and uneven running become more obvious, and further improvements were demanded.

Concerning this point, the present inventors already proposed a clutch mechanism (r) as shown in FIG. 22 (see, for example, Japanese Laid-open Patent No. 5-58097). In this clutch mechanism (r), a circular elastic friction member (s) such as O-ring is interposed between the cylindrical outer circumference of the boss (m) and the cylindrical inner circumference of the tape feed core (o) in a frictionally engaged state.

According to this clutch mechanism (r), in the synchronizing action, the three members (m), (s), and (o) relatively slide smoothly, and hence the discomfort and uneven running due to such elastic and intermittent repeating action have been eliminated.

In the structure of this clutch mechanism (r), however, since the transmission of power is to make use of the frictional force by radial load among the three members (m), (s), and (o), the design and manufacture conditions of the friction member (s) are very strict, and it is hard to manufacture, which was a bottleneck for reducing the manufacturing cost.

That is, if the frictional force is too strong, the sense of manipulation tends to be too heavy in the later phase of use. On the other hand, if the frictional force is too weak, the sense of manipulation tends to be too light in the initial phase of use. Hence, considering their relation, the frictional force must be set at an optimum value.

To obtain the optimum value of frictional force, therefore, in design and manufacture of the friction member (s), it is required to match its inner diameter and outer diameter respectively with the cylindrical outer diameter of the boss (m) and the cylindrical inner diameter of the tape feed core (o), but since the friction member (s) itself is also elastic, its thickness in the radial direction or its sectional diameter must be also taken into consideration. It hence requires an additional process for fine adjustment of the shape and dimensions of the friction member (s) after assembling the clutch mechanism (r).

Still more, since the radial dimensions and other conditions of the friction member (s) are set strictly to assemble the friction member (s) between the cylindrical outer circumference of the boss (m) and the cylindrical inner circumference of the tape feed core (o), it was needed to put in by force, and the assembling work was difficult.

SUMMARY OF THE INVENTION

It is hence a primary object of the invention to present a novel clutch mechanism of a coat film transfer tool solving the problems in the prior art.

It is other object of the invention to present a clutch mechanism having an inexpensive structure easy to manufacture, by making use of a frictional force by thrust load, in a coat film transfer tool of automatic winding type.

It is other object of the invention to present a coat film transfer tool of automatic winding type comprising such clutch mechanism.

The clutch mechanism of the invention is used in a coat film transfer tool of automatic winding type comprising a feed reel with a coat film transfer tape wound thereabout and a take-up reel for collecting the coat film transfer tape after use, rotatably provided in a case that can be held and manipulated by one hand, in which the take-up reel cooperates with the feed reel, for synchronizing the feed speed and take-up speed of the coat film transfer tape in both reels, wherein power transmission means between a tape winding portion for winding up the coat film transfer tape and a rotary drive unit for rotating and driving this tape winding portion is composed in at least one of the two reels, and power transmission of the power transmission means makes use of the frictional force by the thrust load between the tape winding portion and the rotary drive unit, and is connected and disconnected by the difference in torque between these two members.

The coat film transfer tool of the invention comprises a case having shape and dimensions to be held and manipulated by one hand, a feed reel rotatably provided in the case and winding a coat film transfer tape, a take-up reel rotatably provided in the case for collecting the coat film transfer tape after use, an interlock mechanism for linking these two reels so as to cooperate with each other, and a coat film transfer head protruding at the front end of the case for pressing the coat film transfer tape onto the object of transfer, further comprising said clutch mechanism at least in one of the two reels.

The coat film transfer tool comprising the clutch mechanism is classified into the disposable type to be discarded when the coat film transfer tape is used up, and the refill type that can be used repeatedly only by replacing the spent coat film transfer tape with a new one.

In the coat film transfer tool comprising the clutch mechanism of the invention as power transmission means, the take-up speed of the take-up reel gradually becomes faster as compared with the feed speed of the feed reel, and their synchronism is broken to increase the torque acting on the tape winding portion for winding the coat film transfer tape, and herein the clutch mechanism acts to cause the tape winding portion to slide and rotate on the rotary drive unit to eliminate the torque difference between the two, so that the feed speed is synchronized with the take-up speed.

In this case, the power transmission in the clutch mechanism makes use of the frictional force by thrust load between the tape winding portion and the rotary drive unit, and therefore the structual components relatively slide smoothly in this synchronizing action.

In the structure of the clutch mechanism, by properly adjusting the dimensional relation in the thrust direction between the mutual structual components, the frictional force can be set at an optimum value.

These and other objects and features of the invention will be better appreciated by reading the detailed description based on the accompanying drawings and novel facts indicated in the claims.

BRIEF DESCRIPTION OF THE DRAWINGS

FIG. 1(*b*) is a front view-showing the internal structure of the coat film transfer tool by removing the cover body.

FIG. 4(*b*) is a perspective view showing an O-ring in the clutch mechanism.

FIG. 6(*b*) is a plan view showing the rewinding operation unit.

FIG. 8(*b*) is a magnified longitudinal sectional view of a clutch mechanism as the essential part.

FIG. 10(*b*) is a plan view showing a second engaging portion of a clutch mechanism as the essential part.

FIG. 10(*c*) is a magnified longitudinal sectional view showing the engaging state of first and second engaging portions of the clutch mechanism.

FIG. 11(*b*) is a plan view showing a second engaging portion of a clutch mechanism as the essential part.

FIG. 11(*c*) is a magnified longitudinal sectional view showing the engaging state of first and second engaging portions of the clutch mechanism.

FIG. 12(*b*) is a plan view showing a second engaging portion of a clutch mechanism as the essential part.

FIG. 12(*c*) is magnified longitudinal sectional view showing the engaging state of first and second engaging portions of the clutch mechanism.

FIG. 13(*b*) is a perspective view showing a second engaging portion of a clutch mechanism as the essential part.

FIG. 14(*b*) is a perspective view showing a first engaging portion of the clutch mechanism.

FIG. 15(*b*) is a perspective view showing a first engaging portion of the clutch mechanism.

FIG. 16(*b*) is a magnified longitudinal sectional view of a clutch mechanism of the coat film transfer tool.

FIG. 20(*b*) is a plan view corresponding to FIG. 6 (*b*) showing the rewinding operation unit.

FIG. 21(*b*) is a longitudinal sectional view showing an internal structure of the coat film transfer tool.

FIG. 22(*b*) is a longitudinal sectional view showing an internal structure of the coat film transfer tool.

DETAILED DESCRIPTION OF THE PREFERRED EMBODIMENTS

Figure 1:
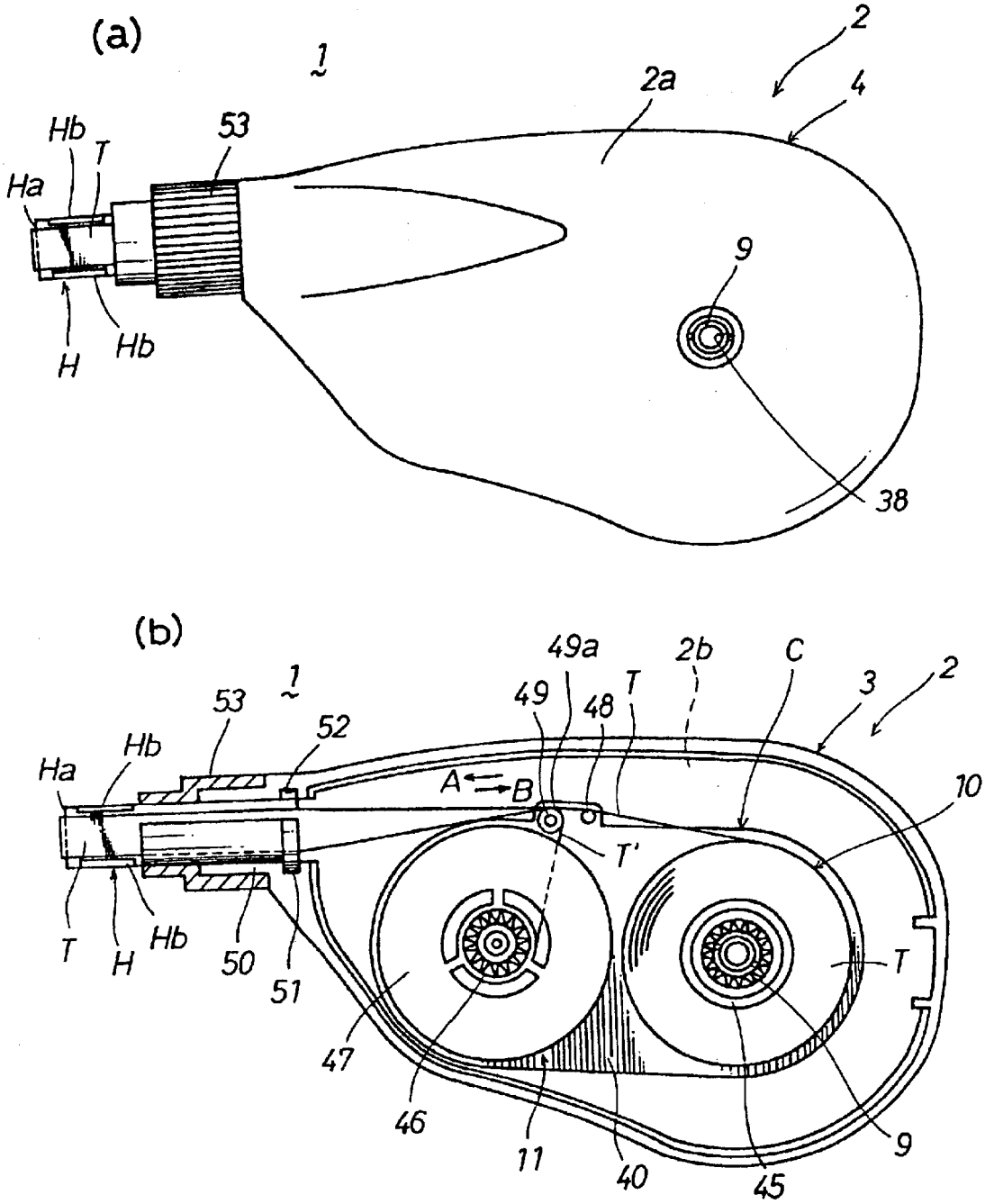
FIG. 1(*a*) is a front view showing the appearance of a coat film transfer type of refill type in embodiment 1 of the invention.

Referring now to the drawings, preferred embodiments of the invention are described in detail below.

FIG. 1 through FIG. 20 show film transfer tools according to the invention, and throughout the drawings the same reference numerals refer to same structual members or elements.

Embodiment 1

A coat film transfer tool according to the invention is shown in FIG. 1 through FIG. 7. This coat film transfer tool 1 is specifically used as an erasing tool for correcting a wrong letter or the like, and comprises essential parts, including a tape drive unit D, a replaceable tape cartridge C, and a coat film transfer head H, provided in a case 2 to be held and manipulated by one hand.

Figure 7:
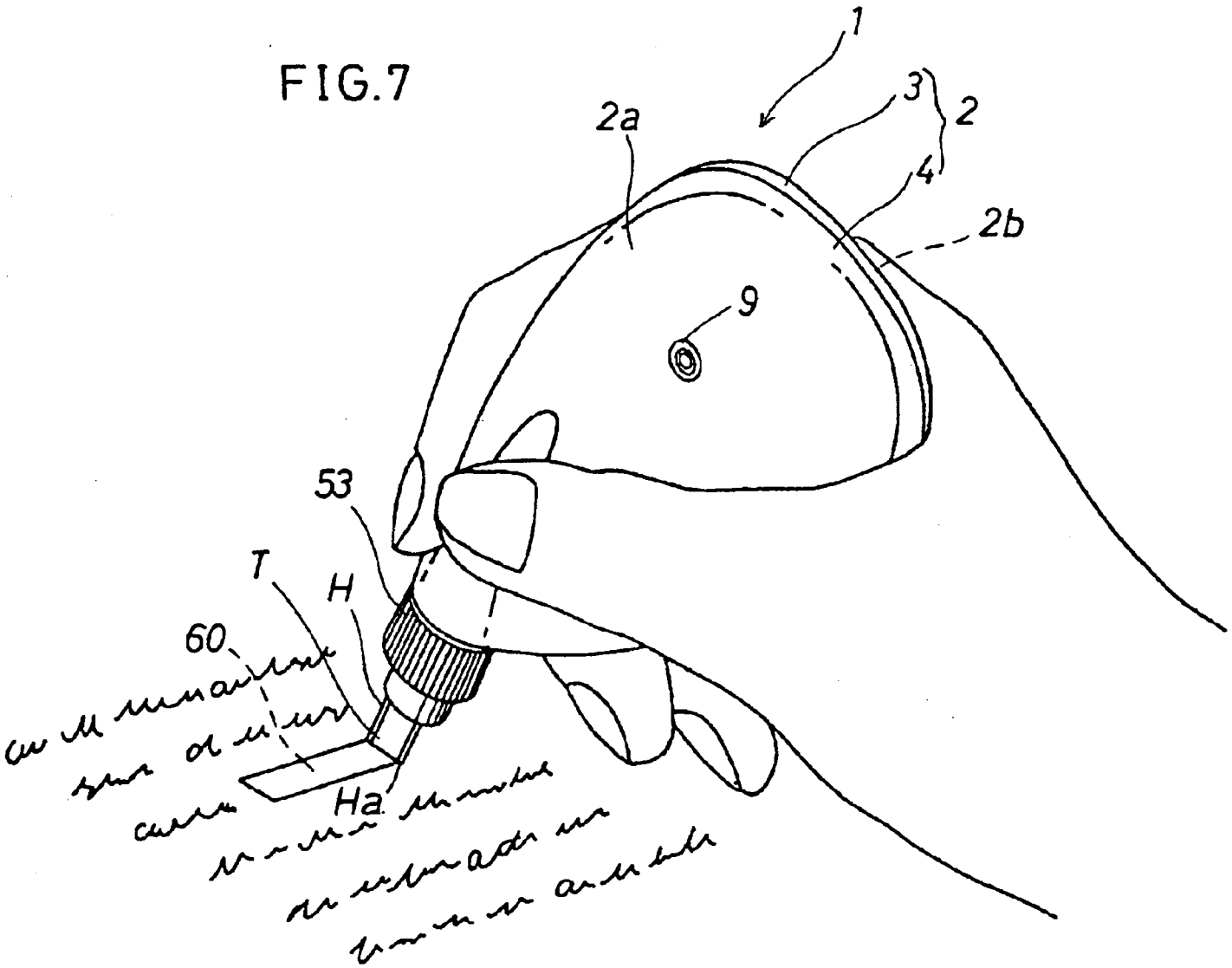
FIG. 7 is a perspective view showing the operating state of the coat film transfer tool.

The case 2 is a plastic flat box formed by injection molding or the like. The case 2 has the front contour shape and dimensions enough to incorporate the tape drive unit D and tape cartridge C, and can be decomposed into a case main body.3 and a cover body 4, and the structual parts D, C, and H are provided in the case main body 3. Flat face and back sides 2*a*, 2*b* of the case 2 form gripping surfaces to be held and manipulated by hand as shown in FIG. 7. Moreover, as described later, an operation hole 38 for rewinding operation is opened in the cover body 4.

The tape drive unit D mainly comprises, as shown in

Figure 2:
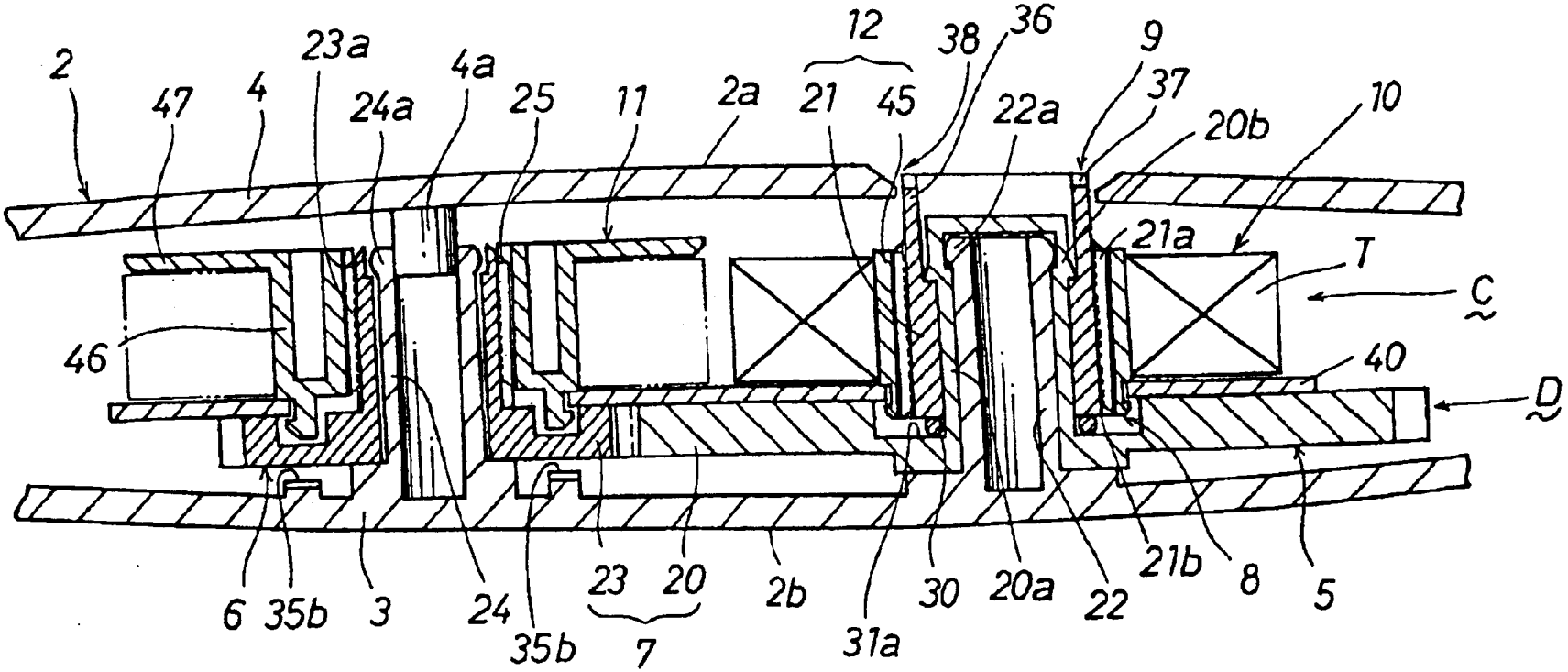
FIG. 2 is a longitudinal sectional view showing an essential structure of the coat film transfer tool.
Figure 3:
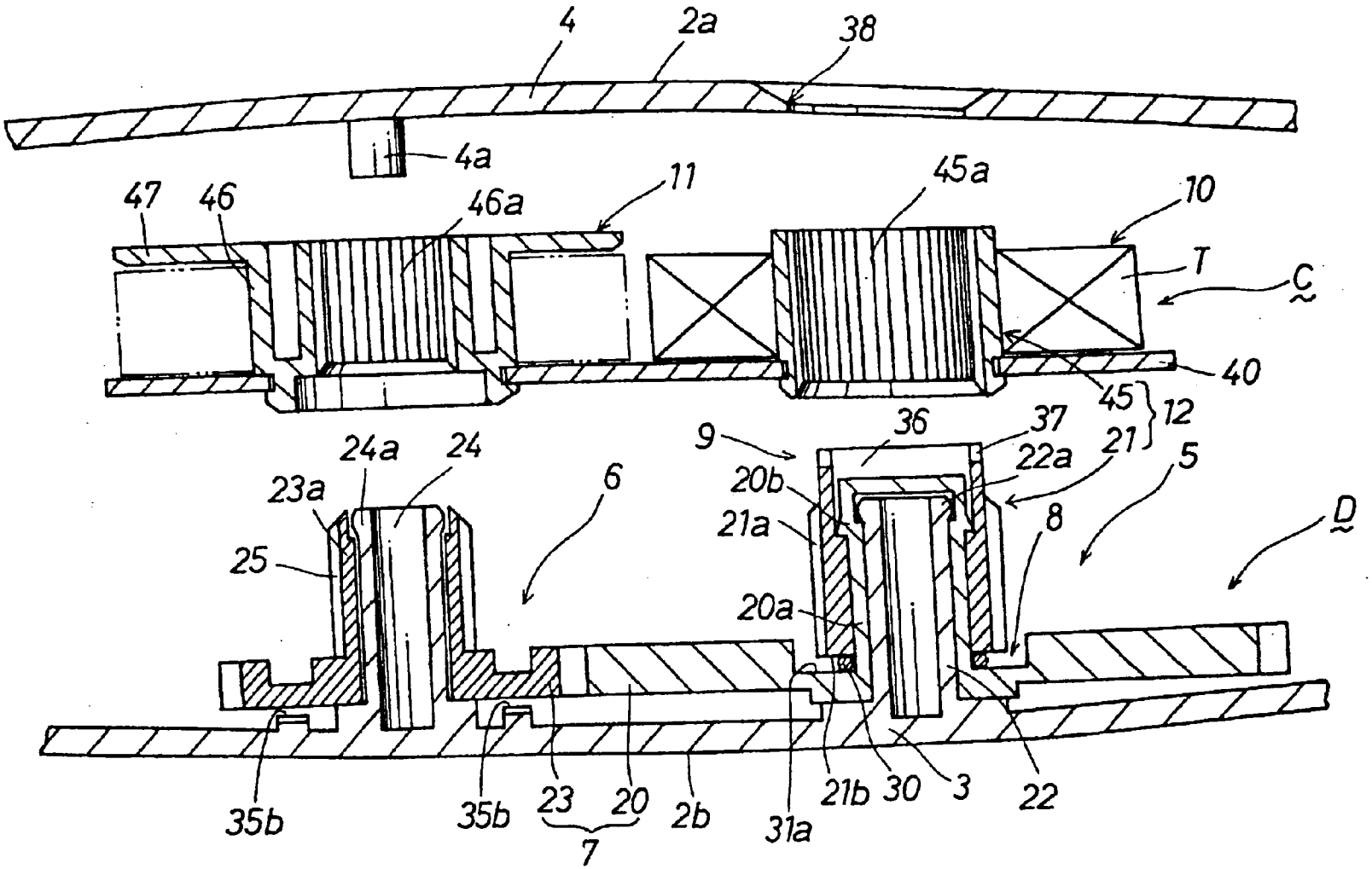
FIG. 3 is a longitudinal view showing a disassembled state of the essential structure of the coat film transfer tool.
Figure 5:
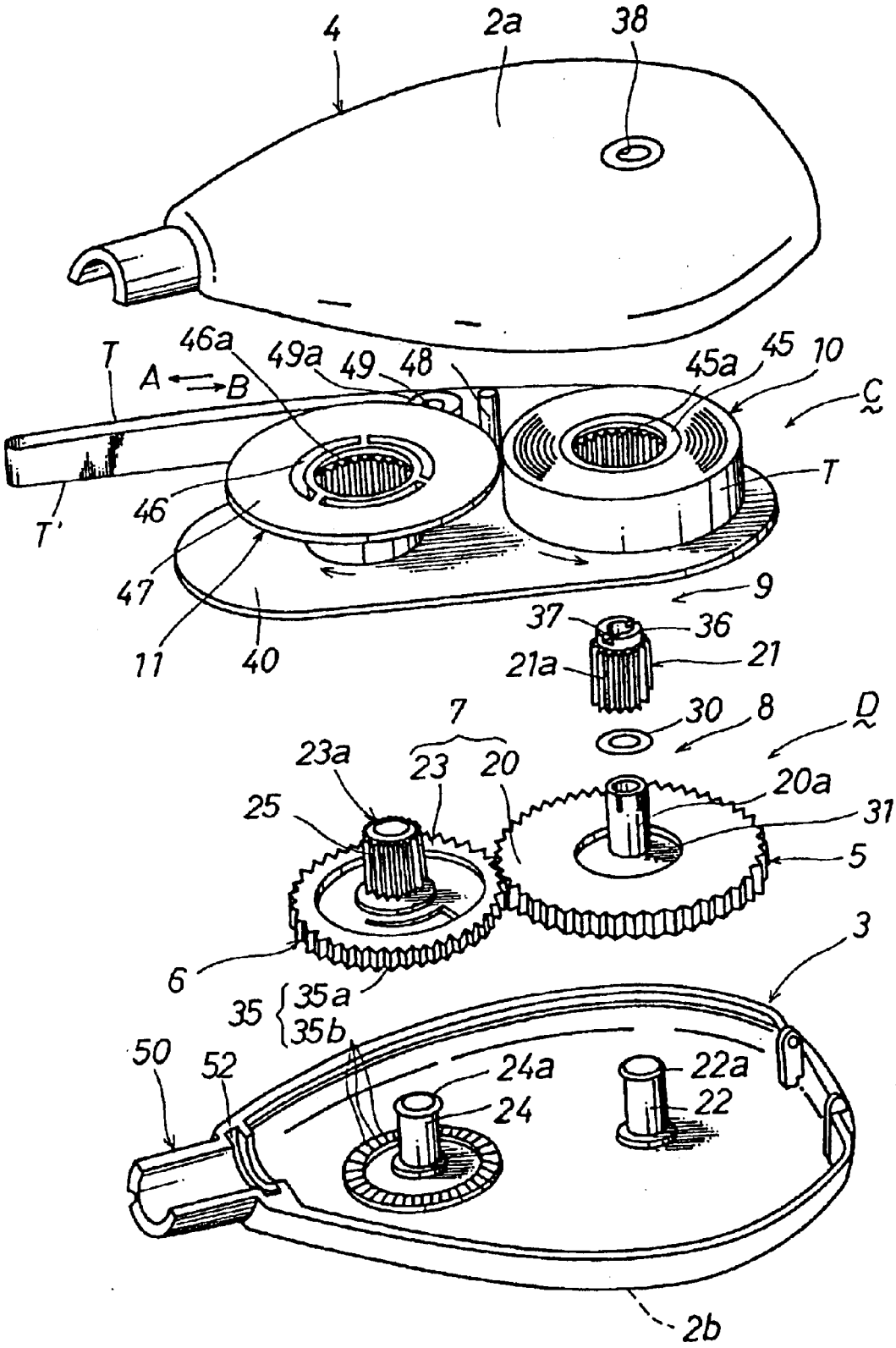
FIG. 5 is a perspective exploded view of the coat film transfer tool.

FIG. 2, FIG. 3, and FIG. 5, a feed rotary unit 5 for rotating and driving a feed reel 10, a take-up rotary unit 6 for rotating and driving a take-up reel 11, an interlock mechanism 7 for interlocking these rotary units 5, 6, a clutch mechanism 8, and a tape rewinding mechanism 9.

The feed rotary unit 5 comprises a drive side rotary gear 20 for composing the interlock mechanism 7, and a driven member 21 for composing a tape winding portion 12 of the feed reel 10. This driven member 21 composes the essential parts of the clutch mechanism 8 and tape rewinding mechanism 9 as described later.

A hollow rotary shaft 20*a* of the drive side rotary gear 20 is rotatably supported on a hollow support shaft 22 provided upright on the inner side of the case main body 3. At the top end of the hollow support shaft 2G, a catch 22*a* for preventing the rotary shaft 20*a* from slipping out is provided.

The driven member 21 is a hollow cylinder, and is rotatably provided on the rotary shaft 20*a* of the drive side rotary gear 20, and a tooth profile engaging portion 21*a* such as serration or spline is formed on its outer circumference as shown in the drawing. At the top end of the rotary shaft 20*a*, a catch 20*b* for preventing the driven member 21 from slipping out is provided.

The take-up rotary unit 6 comprises a follower side rotary gear 23 for composing the interlock mechanism 7, and a hollow rotary shaft 23*a* of the rotary gear 23 is rotatably supported on a hollow support shaft 24 provided upright on the inner side of the case main body 3. At the top end of the hollow support shaft 24, a catch 24*a* for preventing the rotary shaft 23*a* from slipping out is provided. On the outer circumference of the rotary shaft 23*a*, a tooth profile engaging portion 25 such as serration or spline is formed.

The interlock mechanism 7 is composed of the drive side rotary gear 20 and follower side rotary gear 23, and they are engaged with each other at a specific gear ratio. As a result, the take-up rotary unit 6 is rotated in, cooperation with the feed rotary unit 5 always at a specific rotation ratio. This rotation ratio, that is, the gear ratio of the both gears 20, 23 is set properly so that the coat film transfer tape T may be delivered and taken up smoothly, in consideration of the winding diameter of the coat film transfer tape T at the feed reel 10 and take-up reel 11 as mentioned later.

The clutch mechanism 8 is to synchronize the feed speed and take-up speed of the coat film transfer tape T in the feed reel 10 and take-up reel 11 described later, and is provided in the feed rotary unit 5.

Figure 4:
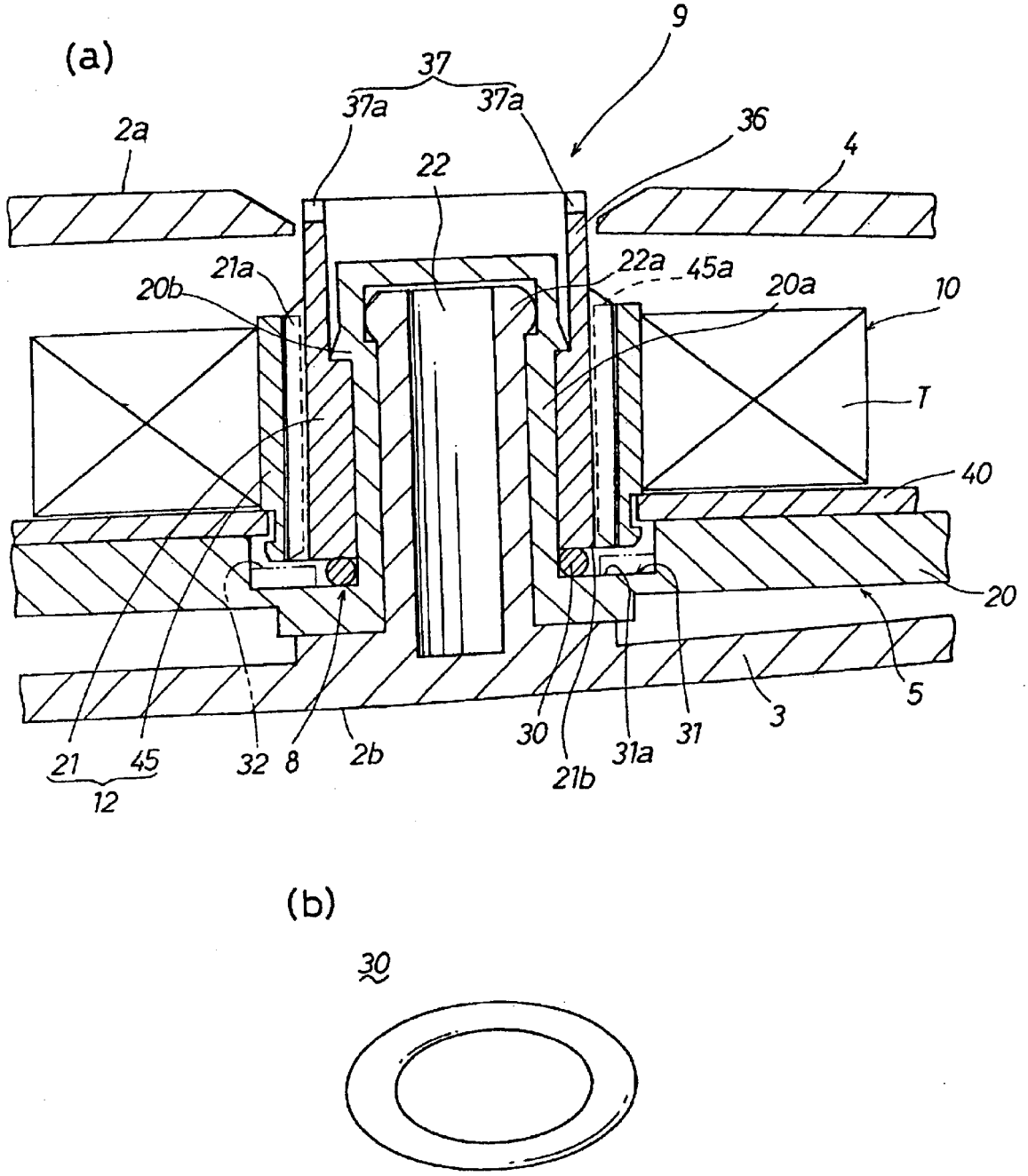
FIG. 4(*a*) is a magnified longitudinal sectional view showing the engaging state of a clutch mechanism which is an essential part in a tape drive unit of the coat film transfer tool.

A specific constitution of the clutch mechanism 8 is shown in FIG. 4, which comprises, as a principal part, an elastomer O-ring (friction member) 30 interposed between the drive side rotary gear 20 and the driven member 21.

This O-ring 30 composes a power transmission unit (power transmission means) between the drive side rotary gear 20 as the rotary drive unit, and the driven member 21 which is the tape winding portion 12, and is made of silicone rubber having a circular section (see FIG. 4 (*b*)). The O-ring 30 is repulsively interposed between the confronting axial ends of the both members 20, 21, and these three members contact with each other in a frictional engagement state. For this purpose, a recess 31 having a flat engaging plane 31*a* is formed on the outer circumference of the rotary shaft 20*a* in the drive side rotary gear 20, and the lower end of the driven member 21 also has a flat engaging plane 21*b*, and the O-ring 30 is repulsively engaged by friction with these engaging planes 31*a*, 21*b*.

Therefore, power transmission of the clutch a mechanism 8 makes use of frictional force due to a thrust load acting between the engaging planes 31*a*, 21*b*, and this frictional force is set at an optimum value by properly adjusting mainly the distance between the engaging planes 31*a*, 21*b*, and the sectional diameter of the O-ring 30.

Moreover, a position defining unit 32, for example, may be provided in the recess 31 (see double dot chain line in FIG. 4(*a*)), and the distance between the engaging planes 31*a*, 21*b* may be defined within a specific value. In such structure, excessive compressive deforming of the O-ring 30 may be effectively prevented, and the clutch mechanism 8 may function always with a stable frictional force. In particular, considering that the driven member 21 serves also as the operation unit of the tape rewinding mechanism 9 described later, there is a possibility of application of excessive thrust load to the O-ring 30, and hence it is preferred to form such position defining unit 32. The inner and outer diameters of the O-ring 30 are set properly within a range allowing the O-ring 30 to be passed through the rotary shaft 20*a* in the drive side rotary gear 20, and to contact with the both engaging planes 31*a*, 21*b*. Therefore, for example, by setting the inner diameter of the O-ring 30 slightly larger than the outer diameter of the rotary shaft 20*a*, the O-ring 30 can be incorporated into the outer circumference of the rotary shaft 20*a*, that is, the recess 31, easily and smoothly.

Further, as shown in FIG. 5, a reverse rotation preventive mechanism 35 to prevent reverse rotation of the reels 10, 11 is provided in the take-up rotary unit 6. This reverse rotation preventive mechanism 35 is composed of a detent pawl 35*a* provided in the follower side rotary gear 23, and multiple reverse rotation preventive pawls 35*b*, 35*b*, . . . provided on the inner side of the case main body 3 annularly and concentrically with the hollow support shaft 24. Accordingly, if the both reels 10, 11 rotate in the arrow direction, the detent pawl 35*a* rides over while elastically deforming the reverse rotation preventive pawls 35*b*, 35*b*, . . . , thereby allowing this normal rotation. On the other hand, when the both reels 10, 11 move to rotate in the opposite direction of the arrow direction, the detent pawl 35*a* is engaged with any one of the reverse rotation preventive pawls 35*b*, 35*b*, . . . , and blocks the reverse rotation. Alternatively, the reverse rotation preventive mechanism 35 may be provided in the drive side rotary gear 20.

The tape rewinding mechanism 9 is designed to eliminate and remove the slack of the coat film transfer tape T between the feed reel 10 and take-up reel 11, and is provided in the tape winding portion 12 of the feed reel 10.

More specifically, the tape rewinding mechanism 9 comprises the hollow cylindrical driven member 21 as principal constituent part as mentioned above, and a top end 36 of the driven member 21 is extended, and a rewinding operation unit 37 is integrally formed in the hollow edge.

Figure 6:
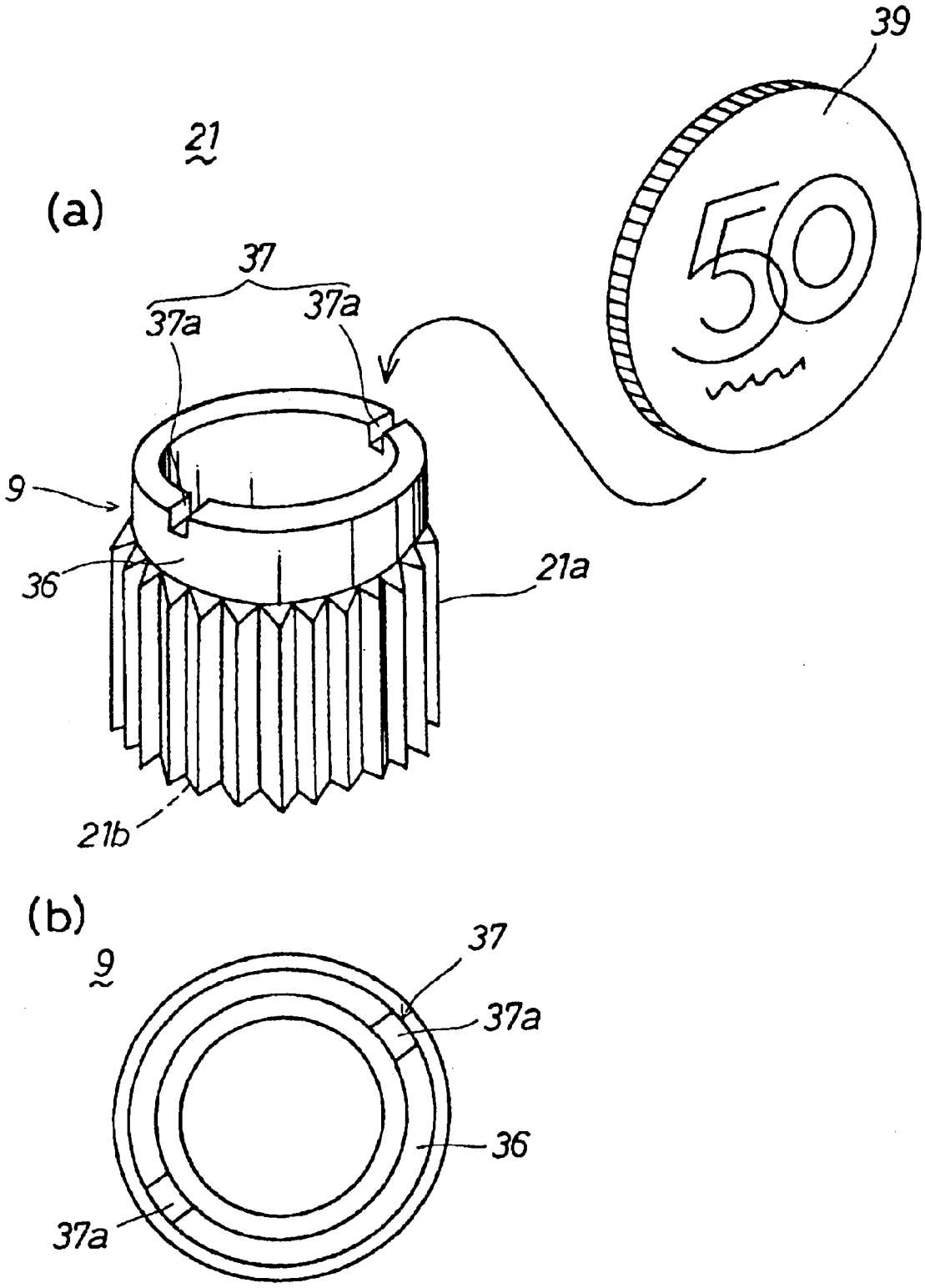
FIG. 6(*a*) is a perspective view showing a rewinding operation unit in the tape drive unit.

The rewinding operation unit 37 faces to the outside of the case 2 through the operation hole 38 formed in the cover body 4 of the case 2. The rewinding operation unit 37 is set so as to be flush with or lower than the surface of the case 2, or the gripping surface 2*a* (see FIG. 4 (*a*)). As shown in FIG. 6, the rewinding operation unit 37 is formed in an operation groove, 37*a* and a plate-shaped operation member 39 such as a coin may be engaged with this operation groove 37*a*.

In the illustrated embodiment, since the top end 36 is a hollow cylindrical form, the operation groove 37 is formed of a pair of grooves 37*a*, 37*a* provided at edges on one straight line in the top end 36. The depth of the grooves 37*a*, 37*a* is set in a range so as to be engaged with the operation member 39, in consideration of the height position of the top end portion of the rotary shaft 20*a*. The number of operation grooves 37 may be properly increased. AS mentioned above, meanwhile, considering the appearance of the coat film transfer tool 1, the hollow support shaft 22 is concealed by the top end portion of the rotary shaft 20*a* so as not to be visible from outside.

Corresponding to the operation groove 37, the inner circumference of the operation hole 38 of the cover body 4 is formed in a taper form as shown in FIG. 4(*a*), and it is designed to engage and operate the operation member, for example, the coin 39 from outside of the case 2 into the operation groove 37.

The tape cartridge C is a replaceable constituent member as a consumable part, and its specific structure is shown in FIG. 2, FIG. 3, and FIG. 5. In the tape cartridge C, the feed reel 10 and take-up reel 11 are rotatably provided on a supporting base plate 40 made of a thin plate material, and the tape cartridge C is detachably mounted on the tape drive unit D of the case main body 3 as shown in FIG. 2 and FIG. 3.

The feed reel 10 and take-up reel 11 are provided with hollow drums 45, 46 for winding the coat film transfer tape T.

These drums 45, 46 have their support ends rotatably, supported on the support base plate 40. In the inner circumference of the drums 45, 46, tooth profile engaging portions 45*a*, 46*a* such as serration or spline are formed, respectively corresponding to the tooth profile engaging portion 21*a* of the driven member 21 and the tooth profile engaging portion 25 of the rotary shaft 23*a* of the follower side rotary gear 23.

The drum 45 of the feed reel 10 is detachably engaged and supported on the driven member 21 through these tooth profile engaging portions 45*a*, 21*a*, and are hence integrated with the driven member 21 in the rotating direction to form the tape winding portion 12. On the other hand, the hollow drum 46 of the take-up reel 11 is detachably engaged and supported on the rotary shaft 23*a* through the tooth profile engaging portions 46*a*, 25, and mounted integrally and rotatably with the rotary shaft 23*a*.

On the outer circumference of the drum 45 of the feed reel 10, the coat film transfer tape T is wound, and the feeding side leading end is connected to the outer circumference of the drum 46 of the take-up reel 11. As the coat film transfer tape T, for example, on one side of a film base material (about 25 to 38 $\mu$m in thickness) such as polyester film, acetate film, other plastics, or paper, a releasing agent layer such as vinyl chloride-vinyl acetate copolymer resin or low molecular weight polyethylene is formed, and a white corrective paint layer is formed thereon, and further an adhesive agent (pressure sensitive adhesive) layer such as polyurethane having a pressure-sensitive adhesion is formed thereon (specific structure is not shown). As the corrective paint layer, so-called dry type is used so as to be able to write thereon immediately after transfer.

The free end of the drum 45 of the feed reel 10 is an open end as it is, and a tape running guide flange 47 is provided at the free end of the drum 46 of the take-up reel 11.

The layout of the reels 10, 11 on the support base plate 40 is as shown in FIG. 2, in which the drums 45, 46 are set so as to be positioned coaxially with respect to the feed rotary unit 5 and take-up rotary unit 6 of the tape drive unit D.

On the support base plate 40 near the mounting positions of the reels 10, 11, a pair of guide pins 48, 49 for guiding the coat film transfer tape T are provided upright and integrally. One guide pin 48 is for guiding the coat film transfer tape T being paid out from the feed reel 10, and the other guide pin 49 is for guiding the coat film transfer tape T' being taken up on the take-up reel 11, and a flanged guide roller 49*a* is rotatably supported on the guide pin 49.

In the tape cartridge C, as shown in FIG. 2 and FIG. 3, the reels 10, 11 are engaged with the both rotary units 5, 6 of the tape drive unit D respectively from above, and the support base plate 40 is mounted on these rotary units 5, 6. As a result, the both reels 10, 11 are instantly set detachably and integrally rotatably in the both rotary units 5, 6. On the other hand, by lifting the support base plate 40 directly to the upper side, the both reels 10, 11 can be instantly detached easily from the both rotary units 5, 6.

The coat film transfer head H is for pressing the coat film transfer tape T on the correction area (object of transfer) such as wrong letter on a sheet of paper, and it is rotatably fitted on a cylindrical front end 50 of the case 2. The cylindrical leading end 50 is composed by assembly of cylindrical halves of the case main body 3 and cover body 4.

The head H is made of plastics having a certain elasticity. The leading or front end portion, of the head H is a thin plate slightly wider than the coat film transfer tape T as shown in FIG. 1, and is formed in a taper section to be gradually thinner toward the leading end, and the leading end Ha of the head H is the pressing portion for pressing the coat film transfer tape T. At both edges of the leading end portion of the head H, guide flanges Hb, Hb for guiding running of the coat film transfer tape T are formed.

The base end portion of the head H is semicylindrical having a semicircular section, and is rotatably supported on the cylindrical front end 50 of the case 2. Reference numeral 51 denotes an arc-shaped flange for positioning in the axial direction provided at the base end of the head H, and this flange 51 is rotatably fitted to an annular groove 52 of the cylindrical front end 50.

With the tape cartridge C being set on the tape drive unit D, the coat film transfer tape T is paid out from the feed reel 10, as shown in FIG. 1(*b*), and is inverted through the pressing portion Ha of the head H through the guide pin 48, and is further wound around the take-up reel 11 through the guide pin 49.

In this relation, although not shown specifically, by rotating and manipulating a cap member 53 detachably fitted to the cylindrical front end 50, the head H is selectively positioned at the shown application position (laterally pulling position), and the orthogonal coat film transfer tape exchange position (also vertically pulling position).

In the former application position, the pressing portion Ha of the head H guides the coat film transfer tape T so that the coat film transfer tape T may be nearly opposite to the gripping surfaces 2*a*, 2*b* of the case 2, that is, the face and back sides of the coat film transfer tape T may be directed nearly in the same direction to the gripping surfaces 2*a*, 2*b* (that is, nearly parallel to each other). On the other hand, at the latter coat film transfer tape exchange position, the pressing portion Ha of the head H guides the coat film transfer tape T so that the coat film transfer tape T may remain in the winding position of the feed reel 10 and take-up reel 11, that is, the face and back sides of the coat film transfer tape T may be directed nearly in opposite direction to the gripping surfaces 2*a*, 2*b* (that is, nearly orthogonal to each other).

In thus constructed coat film transfer tool 1, by the pressing operation of the coat film transfer head H as mentioned later, a tensile force applied to the coat film transfer tape T (arrow A direction in FIG. 1) acts on the feed reel 10 as torque, the drive side rotary gear 20 is rotated through the tape winding portion 12 of the feed reel 10, and further through the clutch mechanism 8. This torque rotates the follower side rotary gear 23 and further the take-up reel 11 in cooperation through the interlock mechanism 7, so that the coat film transfer tape T' after use is taken up automatically by the take-up reel 11.

In this case, the rotation ratio of the drive side rotary gear 20 and follower side rotary gear 23 (corresponding to the gear ratio of the interlock mechanism 7) is always constant, whereas the ratio of the outer diameter of the coat film transfer tape T in the feed reel 10 and the outer diameter of the coat film transfer tape T' in the take-up reel 11 varies with the passing of time and is not constant. That is, as being used, the outer diameter of the coat film transfer tape T in the feed reel 10 becomes gradually smaller, while the H outer diameter of the coat film transfer tape T' in the take-up reel 11 gradually increases to the contrary.

Hence, the take-up speed of the take-up reel 11 is gradually increased in comparison with the feed speed of the feed reel 10, and the synchronism of the two speed is broken, and the torque acting on the feed reel 10 gradually increases. In consequence, this torque overcomes the frictional force of the clutch mechanism 8, and the tape winding portion 12 slides and rotates against the drive side rotary gear 20, and the torque difference between the both reels 10, 11 is eliminated, and the feed speed is synchronized with the take-up speed, so that smooth running of the coat film transfer tape T is assured.

As mentioned above, power transmission in the clutch mechanism 8 makes use of the frictional force by the thrust load between the tape winding portion 12 and the drive side rotary gear 20, and in the construction of the clutch mechanism 8, the frictional force can be set to an optimum value by properly adjusting the relative dimensions in the thrust direction among the constituent members 20, 21, 30.

Due to wrong handling by the user or the like, if the coat film transfer tape T is slacked between the feed reel 10 and take-up reel 11, the operation groove 37 of the tape rewinding mechanism 9 is rotated and manipulated in the rewinding direction from outside of the case 2 (rotating in the direction of arrow B in FIG. 1(*b*)), and thereby the slack of the coat film transfer tape T is eliminated and removed.

In this case, the torque in the rewinding direction B applied to the driven member 21 through the operation groove 37 is transmitted to the drum 45 through the tooth profile engaging portions 21*a*, 45*a*, and the drum 45 rotates in the rewinding direction B. On the other hand, by the reverse rotation blocking force by the reverse rotation preventive mechanism 35 and the action of the clutch mechanism 8, the rotary gears 20, 23 of the tare drive unit D and the drum 46 of the take-up reel 11 are set in stopped state. As a result, the slack of the coat film transfer tape T between the both reels 10, 11 is eliminated and removed.

In the coat film transfer tool 1 of the embodiment, by selectively positioning the head H at either laterally pulling position or vertically pulling position, it is usable in both lateral pull suited to correction of part of sentence written laterally as in European language, and in vertical pull suited to correction of part of sentence written vertically as in Japanese language.

For example, in the use for lateral pull, as shown in FIG. 7, the gripping surfaces 2*a*, 2*b* of the case 2 are held like a writing tool. In this gripping position, the pressing portion Ha of the head H is fitted to the starting end (left end) of the correction area (object of transfer) on the paper to correct a wrong letter or the like, and is directly moved laterally, that is, in the right direction on the paper and stopped at the terminal end (right end) of the correction area 60.

By this operation, the corrective paint layer (white) of the coat film transfer tape T in the pressing portion Ha of the head H is peeled off from the film base material, and is transferred and applied on the correction area 60. As a result, the wrong letter is concealed and a correct letter can be immediately written over.

Embodiment 2

Figure 8:
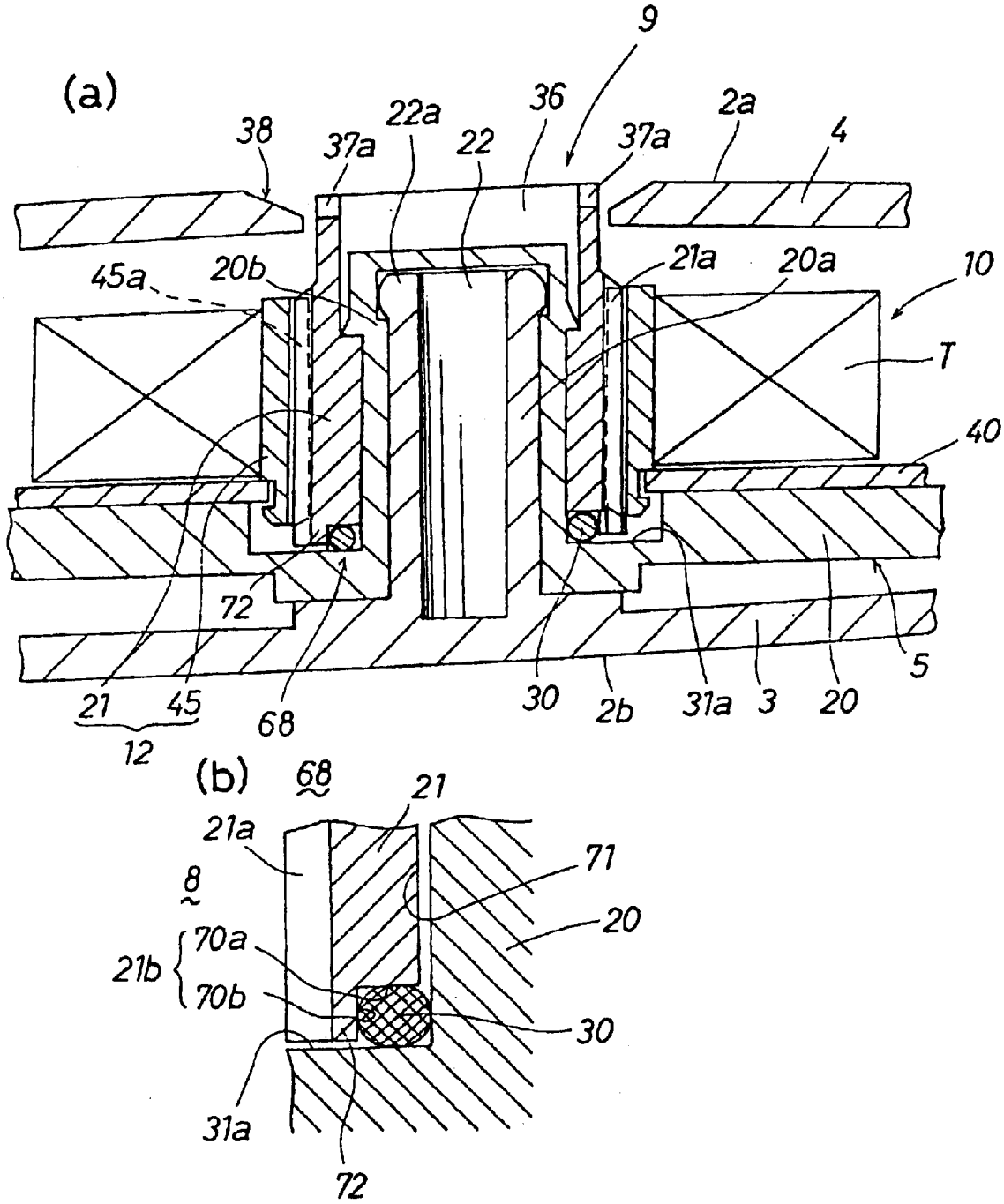
FIG. 8(*a*) is a longitudinal sectional view showing essential parts of a tape drive unit in a refill type coat film transfer tool in embodiment 2 of the invention.

This embodiment is shown in FIG. 8, and the clutch mechanism 8 of embodiment 1 is slightly modified.

That is, in the clutch mechanism 68 of the embodiment, the engaging plane 21*b* of the driven member 21 un is formed so as to surround the O-ring 30 as shown in a magnified sectional view in FIG. 6(*b*). That is, the engaging plane 21*b* is composed of an annular flat surface 70*a* frictionally engaged with the upper surface of the 0ring 30 opposite parallel to the engaging plane 31*a* of the drive side rotary gear 20, and a cylindrical inner circumference 70*b* frictionally engaged with the outer side of the O-ring 30 opposite to the rotary shaft outer circumference 71 of the drive side rotary gear 20.

For power transmission of the clutch mechanism 68, both the frictional force by thrust load acting between the annular flat surface 70*a* and engaging plane 31*a*, and the frictional force by radial load acting between the cylindrical inner circumference 70*b* and rotary shaft outer circumference 71 are utilized.

In this case, power transmission of the clutch mechanism 68 is mainly based on the frictional force by thrust load, and the frictional force by radial load is only supplementary for adjusting the transmission force, so that fine adjustment of pressure is enabled.

A lower end portion 72 for forming the cylindrical inner circumference 70*b* of the driven member 21 functions, same as the position defining portion 32 in embodiment 1, as the position defining portion for suppressing the distance between the annular flat surface 70*a* and the engaging plane 31*a* within a set value, and hence prevents the O-ring 30 from being compressed and deformed excessively in the vertical direction.

The other construction and action are same in embodiment 1.

Embodiment 3

Figure 9:
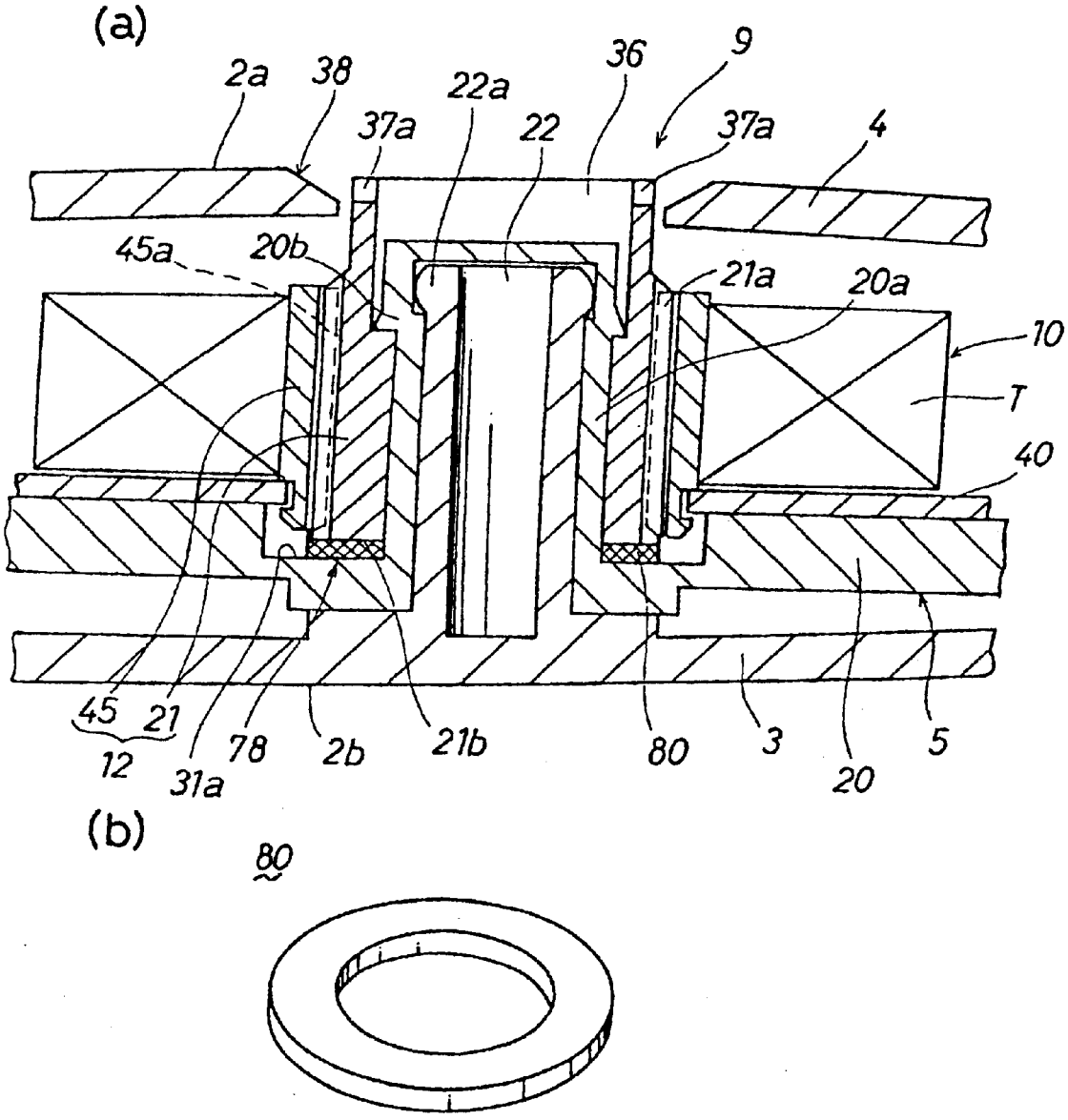
FIG. 9(*a*) is a longitudinal sectional view showing essential parts of a tape drive unit in a refill type coat film transfer tool in embodiment 3 of the invention, FIG. 9(*b*) is a perspective view showing a sheet of a clutch mechanism as the essential part.

This embodiment is shown in FIG. 9, and the clutch mechanism 8 of embodiment 1 is slightly modified.

That is, in the clutch mechanism 78 of the embodiment, a plastic friction sheet 80 is used as a friction member interposed between the engaging plane 21*b* of the driven member 21 and the engaging plane 31*a* of the drive side rotary gear 20.

This friction sheet 80 is a thin wall plate material formed in an annular form as shown in FIG. 9(*b*), and its upper and lower flat surfaces are frictionally engaged respectively with the engaging planes 31*a*, 21*b*.

The inner and outer diameters and thickness of the annular friction sheet 80 are set in the same conditions as the inner and outer diameters and sectional diameter of the O-ring 30 in embodiment 1.

The other construction and action are same in embodiment 1.

Embodiment 4

Figure 10:
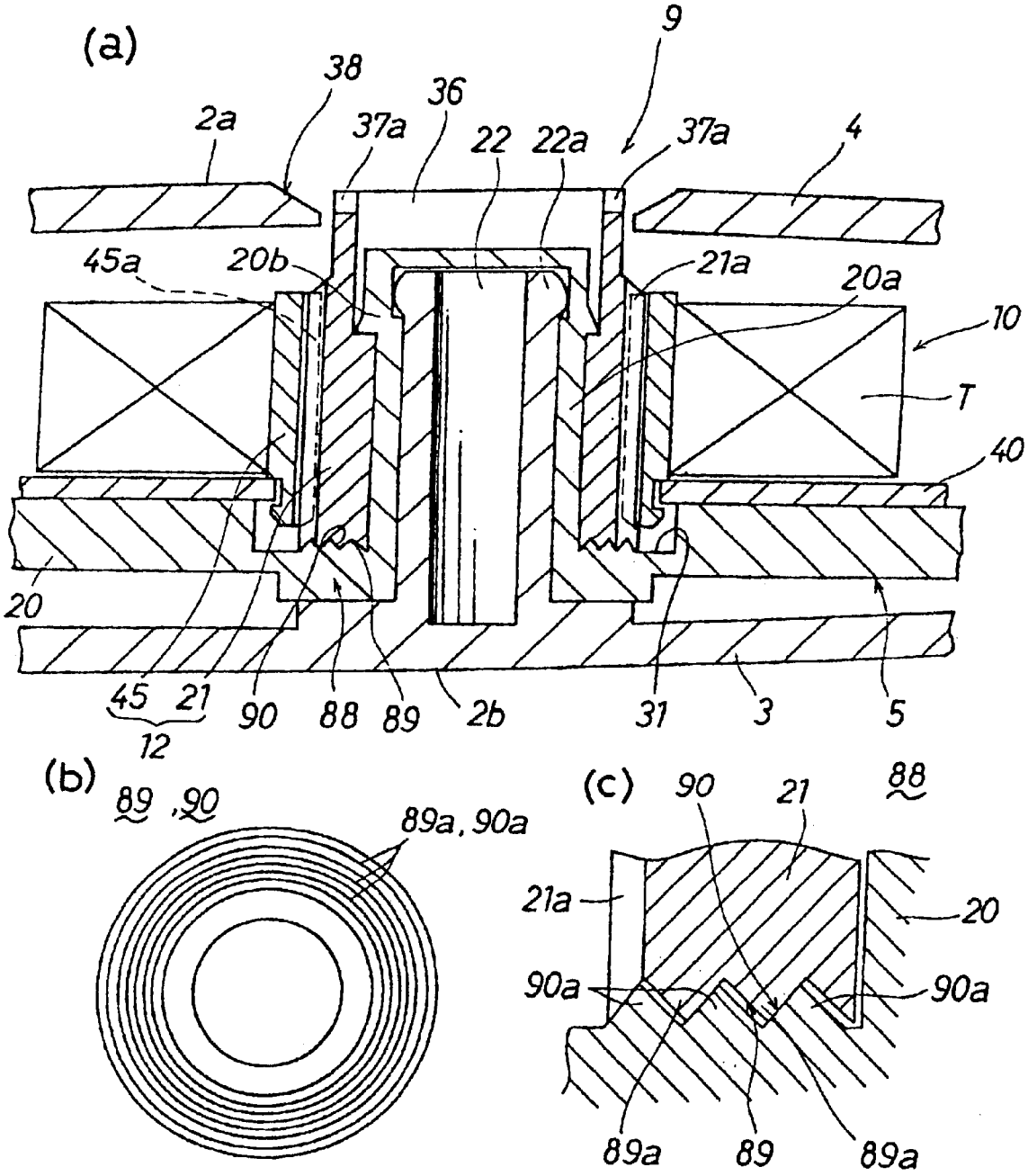
FIG. 10(*a*) is a longitudinal sectional view showing essential parts of a tape drive unit in a refill type coat film transfer tool in embodiment 4 of the invention.

This embodiment is shown in FIG. 10, in which the friction member in the clutch mechanism of embodiments 1 to 3 is omitted, and the driven member 21 and drive side rotary gear 20 are directly engaged with each other frictionally.

That is, in the clutch mechanism 88 of the embodiment, in the confronting axial end surfaces of the driven member 21 and drive side rotary gear 20, a first engaging portion 89 and a second engaging portion 90 are respectively formed, and these engaging portions 89, 90 are engaged frictionally.

These engaging portions 89, 90 are composed of plural annular ribs 89*a*, 90*a* provided concentrically with the driven member 21 and drive side rotary gear 20. These annular ribs 89*a*, 90*a* have both angle sections consisting of a pair of slopes as shown in FIG. 10(*c*), and the diameters of these confronting annular ribs 89*a*, 9*f*l are set slightly different from each other. Consequently, these annular ribs 89*a*, 90*a* are composed so that the slopes on one side may contact frictionally with each other as shown in FIG. 10(*c*).

Therefore, the frictional force of the clutch mechanism 88 can be adjusted by increasing or decreasing the contact area of the annular ribs 89*a*, 90*a* or the contacting force, and in this case, the frictional coefficient of the constituent materials of the driven member 21 and drive side rotary gear 20 (for example, ABS (acrylonitrile-butadiene-styrene) resin, etc.) is also taken into consideration.

According to this embodiment, as compared with the foregoing embodiments, the number of parts is decreased, and it is suited to mass production, so that the manufacturin cost and product cost may be curtailed.

The other construction and action are same in embodiment 1.

Embodiment 5

Figure 11:
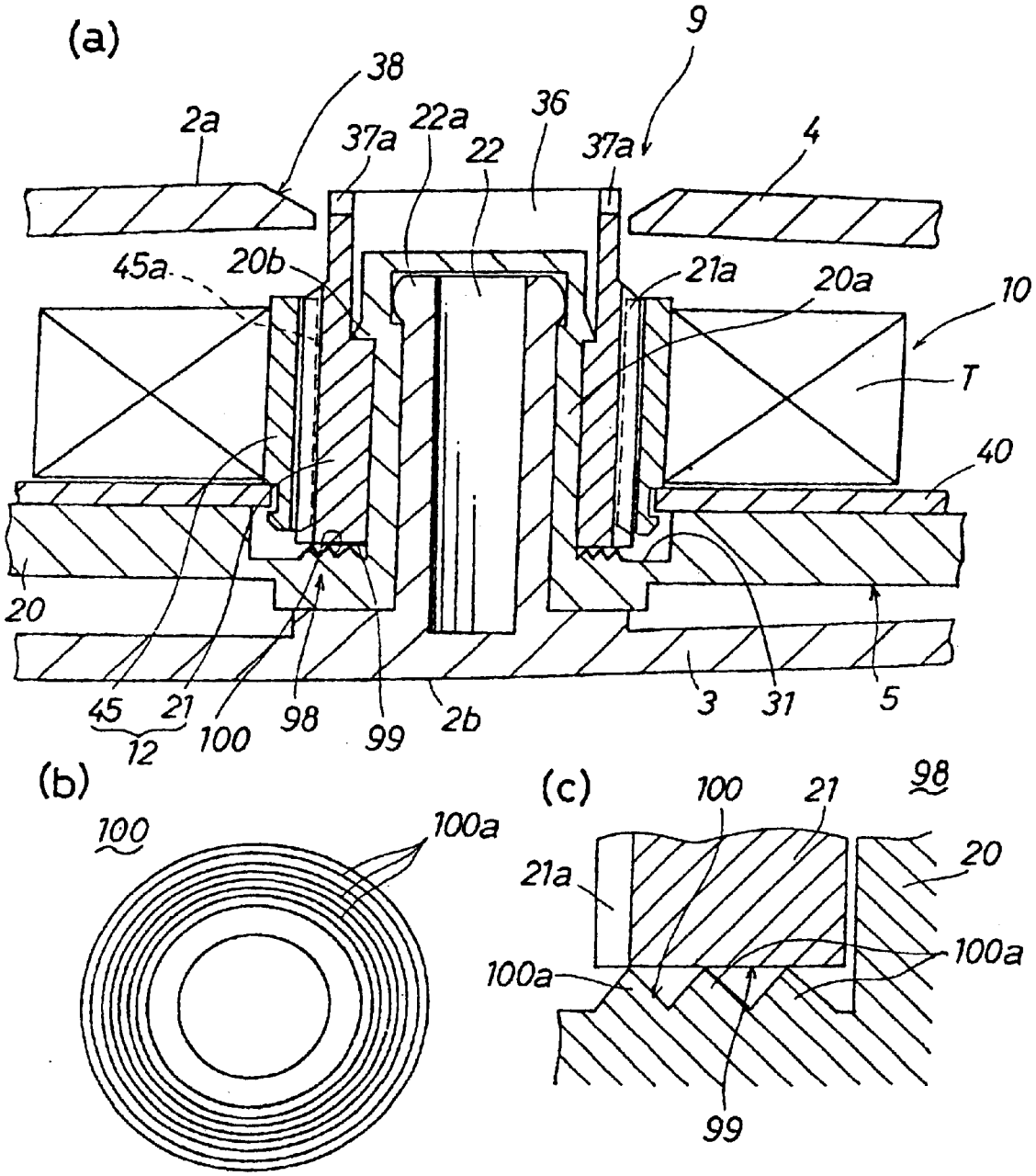
FIG. 11(*a*) is a longitudinal sectional view showing essential parts of a tape drive unit in a refill type coat film transfer tool in embodiment 5 of the invention.

This embodiment is show in FIG. 11, and the clutch mechanism 88 of embodiment 4 is slightly modified.

That is, in the clutch mechanism 98 of the embodiment, a first engaging portion 99 of the driven member 21 is formed on a flat plane, and a second engaging portion 100 of the drive side rotary gear 20 is composed of plural annular ribs 100*a* (see FIG. 11(*b*)) same as the second engaging portion 90 of embodiment 4 (see FIG. 10). As a result, the flat plane 99 and the leading ends of the annular ribs 100*a*, 100*a*, . . . are formed to contact with each other frictionally (see FIG. 11(*c*)).

Therefore, the frictional force of the clutch mechanism 98 can be adjusted by increasing or decreasing the height of the annular ribs 100*a*. Although not shown, moreover, the engaging portions 99, 100 may be formed in reverse composition of the composition shown in FIG. 11, that is, the first engaging portion 99 may be composed of plural annular ribs, and the second engaging portion 100 may be formed on a flat plane.

The other construction and action are same in embodiment 4.

Embodiment 6

Figure 12:
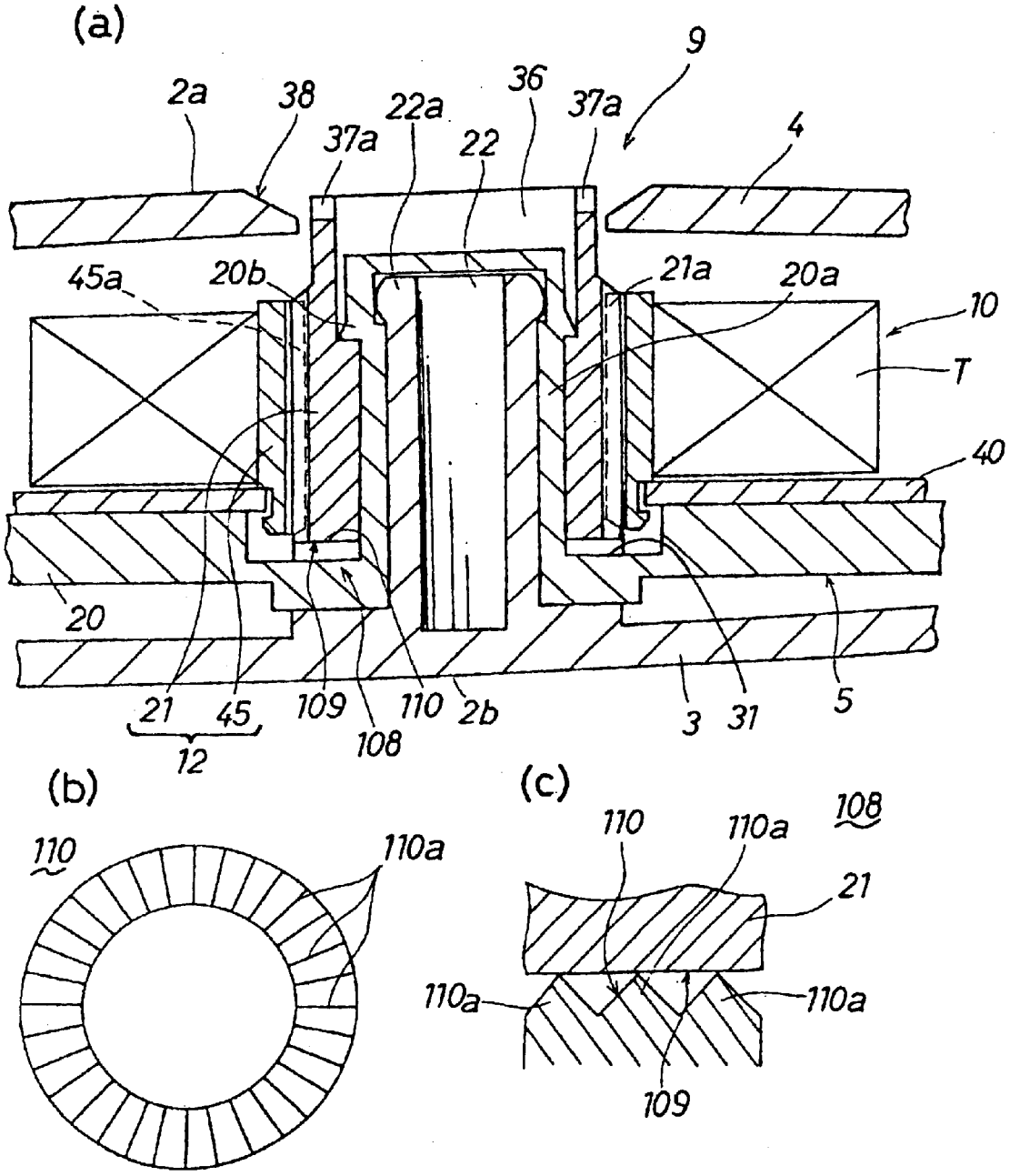
FIG. 12(*a*) is a longitudinal sectional view showing essential parts of a tape drive unit in a refill type coat film transfer tool in embodiment 6 of the invention.

This embodiment is shown in FIG. 12, and the clutch mechanism 88 of embodiment 4 is slightly modified.

That is, in the clutch mechanism 108 of the embodiment, a first engaging portion 109 of the driven member 21 is formed on a flat plane, and a second engaging portion 110 of the drive side rotary gear 20 is composed of multiple radial ribs 110*a* (see FIG. 12(*b*)), formed at equal intervals in the circumferential direction, concentrically with the drive side rotary gear 20. As a result, the flat plane 109 and the leading ends of the radial ribs 110*a*, 110*a*, . . . are formed to contact with each other frictionally (see FIG. 12(*c*)).

Therefore, the frictional force of the clutch mechanism 108 can be adjusted by increasing or decreasing the height of the radial ribs 110*a*. Although not shown, moreover, the engaging portions 109, 110 may be formed in reverse composition of the composition shown in FIG. 12, that is, the first engaging portion 109 may be composed of multiple radial ribs, and the second engaging portion 110 may be formed on a flat plane.

The other construction and action are same in embodiment 4.

Embodiment 7

Figure 13:
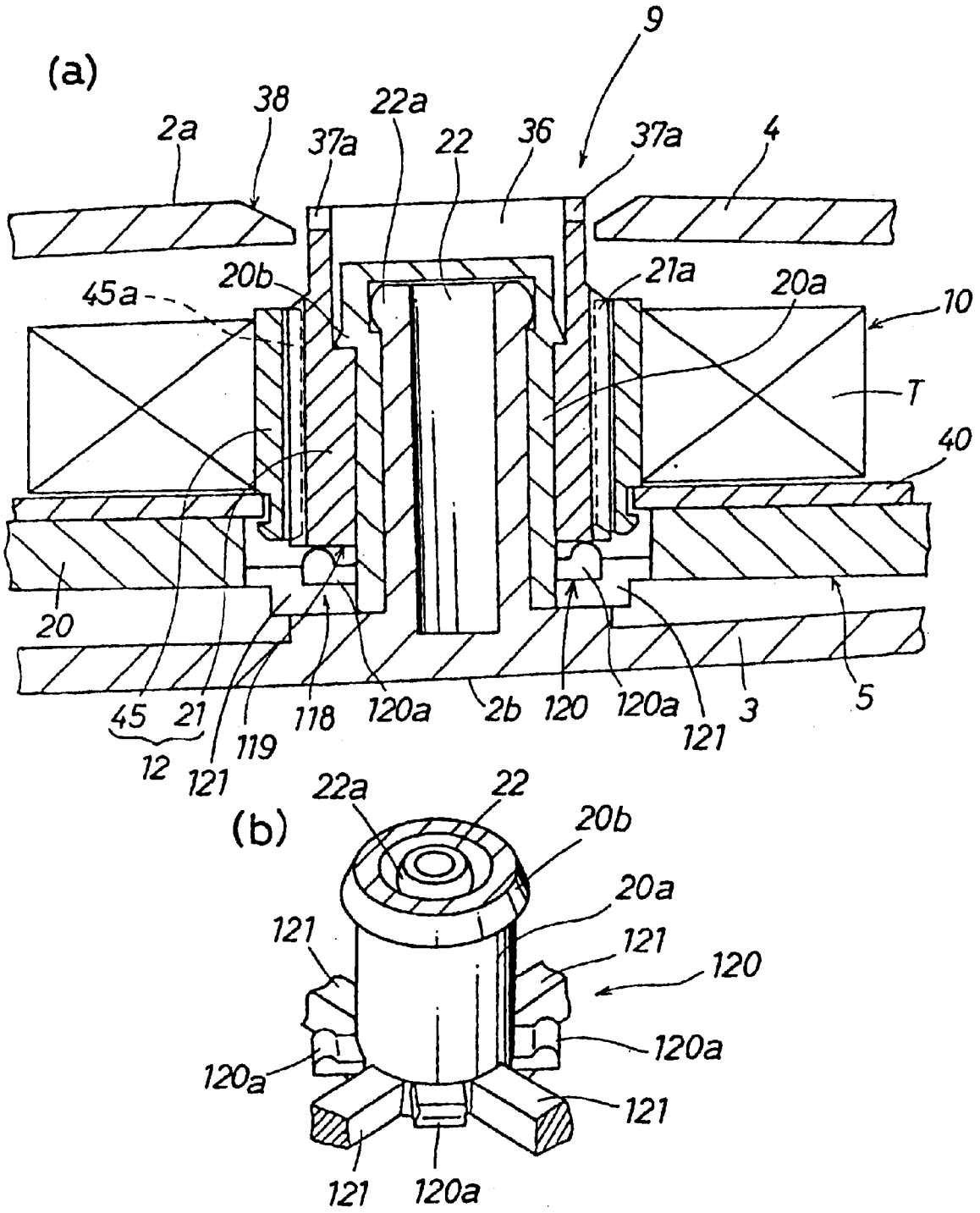
FIG. 13(*a*) is a longitudinal sectional view showing essential parts of a tape drive unit in a refill type coat film transfer tool in embodiment 7 of the invention.

This embodiment is shown in FIG. 13, and the clutch mechanism 88 of embodiment 4 is slightly modified.

That is, in the clutch mechanism 118 of the embodiment, a first engaging portion 119 of the driven member 21 is formed on a flat plane, and a second engaging portion 120 of the drive side rotary gear 20 is composed of plural (four in this drawing) engaging protrusions 120*a* having elasticity in the axial direction, that is, the vertical direction.

The engaging protrusions 120*a* are, more specifically, formed as being extended outward in the radial direction from the outer circumference of the rotary shaft 20*a* of the drive shaft rotary gear 20 as shown in FIG. 13(*b*), and the engaging protrusions 120*a* are disposed at equal intervals in the circumferential direction on the outer circumference of the rotary shaft 20*a*. In this relation, the rotary shaft 20*a* and the outer circumference of the drive side rotary gear 20 are coupled by plural (four in this drawing) coupling members 121 disposed between engaging protrusions 120*a*, 120*a*.

The flat plane 109 and the leading ends of the engaging protrusions 120*a*, 120*a*, . . . are formed to contact with each other frictionally (see FIG. 13(*a*)).

The frictional force of the clutch mechanism 118 can be adjusted by increasing or decreasing the elastic force applied to the engaging protrusions 120*a*, or increasing or decreasing the number of engaging protrusions 120*a*.

The other construction and action are same in embodiment 4.

Embodiment 8

Figure 14:
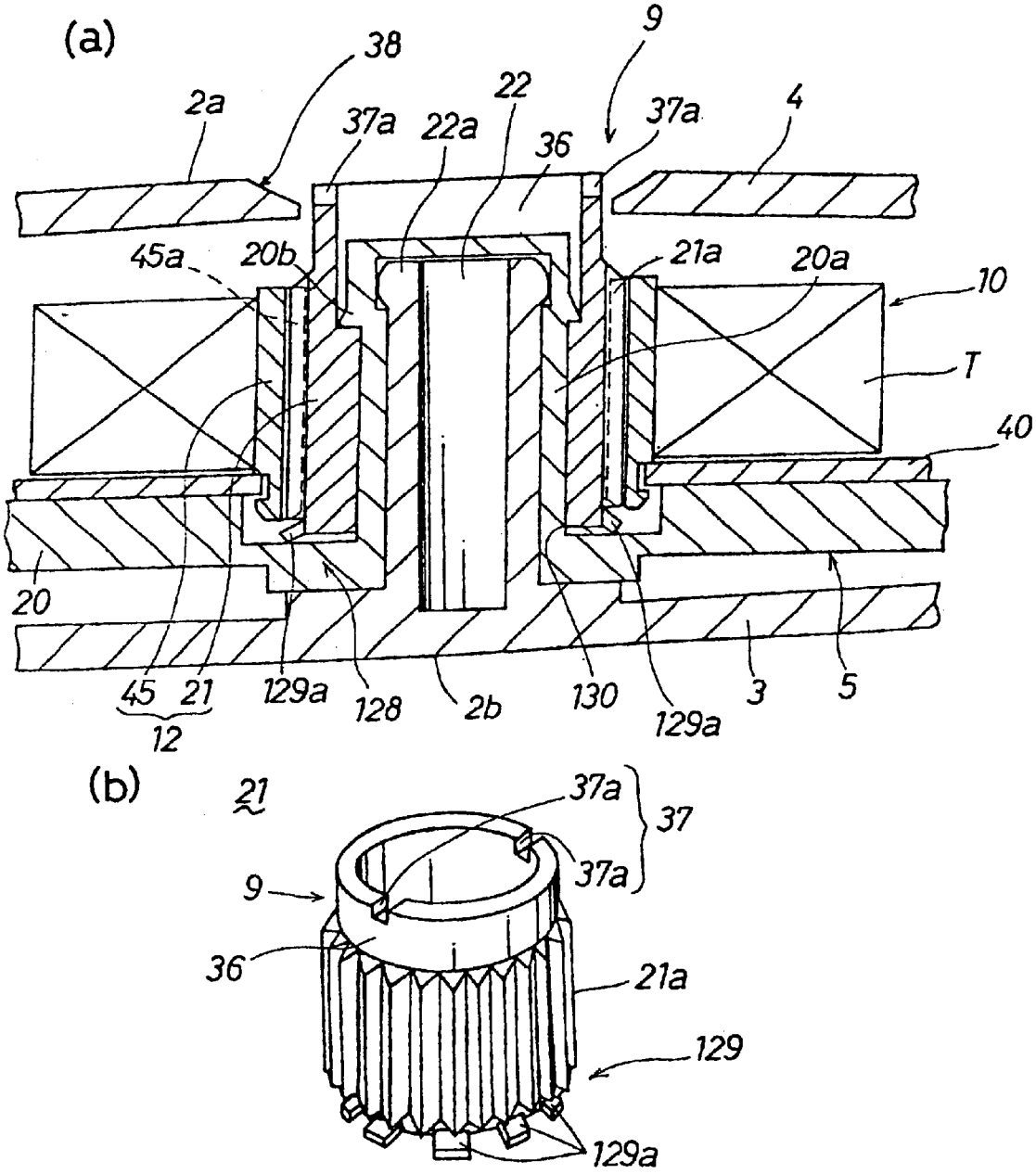
FIG. 14(*a*) is a longitudinal sectional view showing a clutch mechanism in a tape drive unit in a refill type, coat film transfer tool in embodiment 8 of the invention.

This embodiment is shown in FIG. 14, and the clutch mechanism 88 of embodiment 4 is slightly modified That is, in the clutch mechanism 128 of the embodiment, a first engaging portion 129 of the driven member 21 is composed of plural engaging protrusions 129*a* having elasticity in the axial direction, and a second engaging portion 130 of the drive side rotary gear 20 is formed on a flat plane.

The engaging protrusions 129*a* are specifically formed by projecting radially downward from the lower end outer peripheral edge of the driven member 21, and are disposed at equal intervals on the whole circumference in the circumferential direction at the lower end outer peripheral edge of the driven member 21.

The leading ends of the engaging protrusions 129*a* and the flat plane 130 are formed to contact with each other frictionally, and the frictional force of the clutch mechanism 128 can be adjusted by increasing or decreasing the elastic force applied to the engaging protrusions 129*a*, or increasing or decreasing the number of engaging protrusions 129*a*.

The other construction and action are same in embodiment 4.

Embodiment 9

Figure 15:
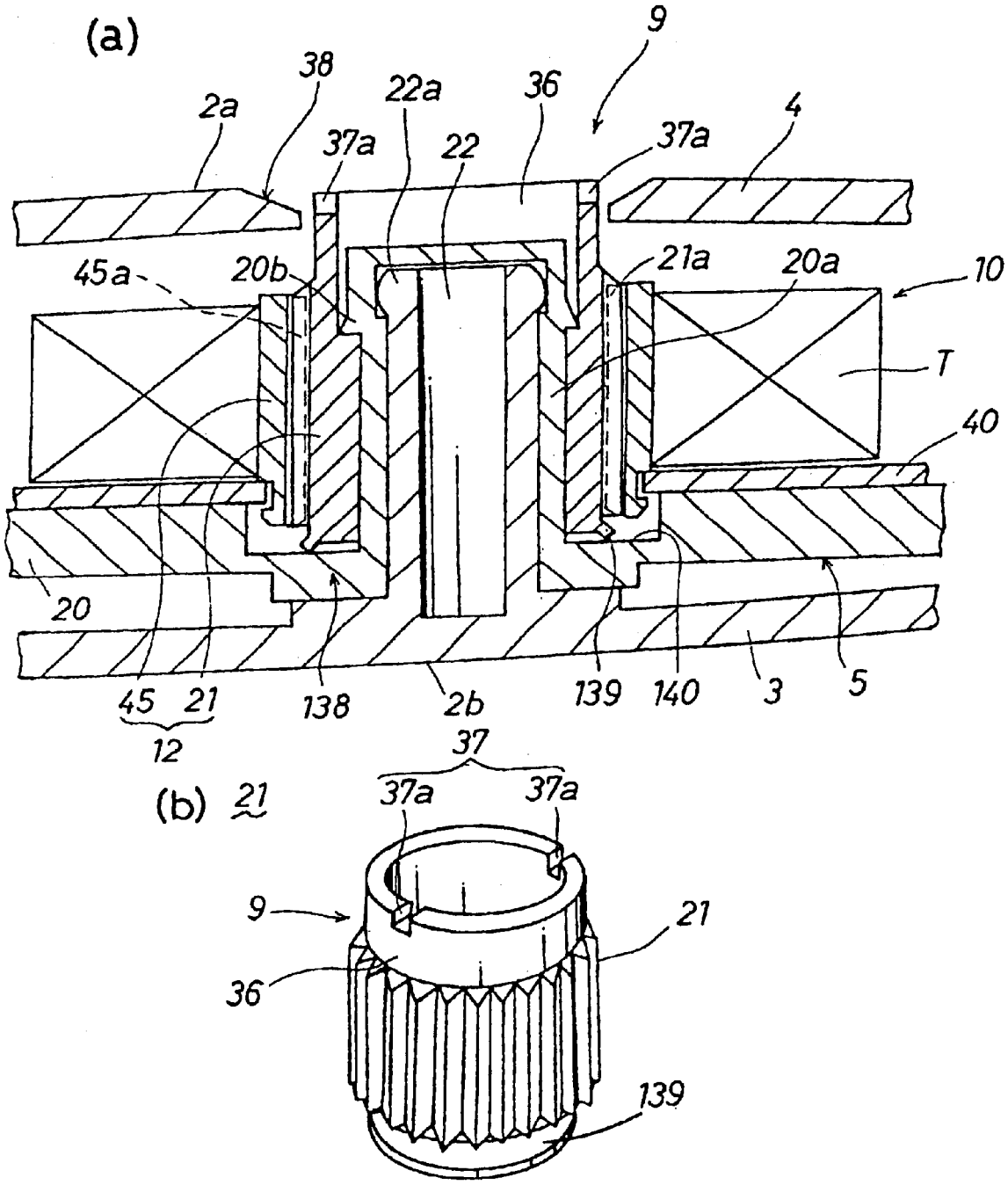
FIG. 15(*a*) is a longitudinal sectional view snowing a clutch mechanism in a tape drive unit in a refill type coat film transfer tool in embodiment 9 of the invention.

This embodiment is shown in FIG. 15, and the clutch mechanism 128 of embodiment 8 is slightly modified.

That is, in the clutch mechanism 138 of the embodiment, a first engaging portion 139 of the driven member 21 is an annular engaging flange having elasticity in the axial direction, or the vertical direction, and a second engaging portion 140 of the drive side rotary gear 20 is formed on a flat plane. The engaging flange 139 is specifically in a form of conical flange having a sectional shape projecting radially downward from the lower end outer peripheral edge of the driven member 21.

The leading end of the engaging flange 139 and the flat plane 140 are formed to contact with each other frictionally, and the frictional force of the clutch mechanism 138 can be adjusted by varying the projection length or inclination angle of the engaging flange 139.

The other constitution and action are same in embodiment 8 .

Embodiment 10

Figure 16:
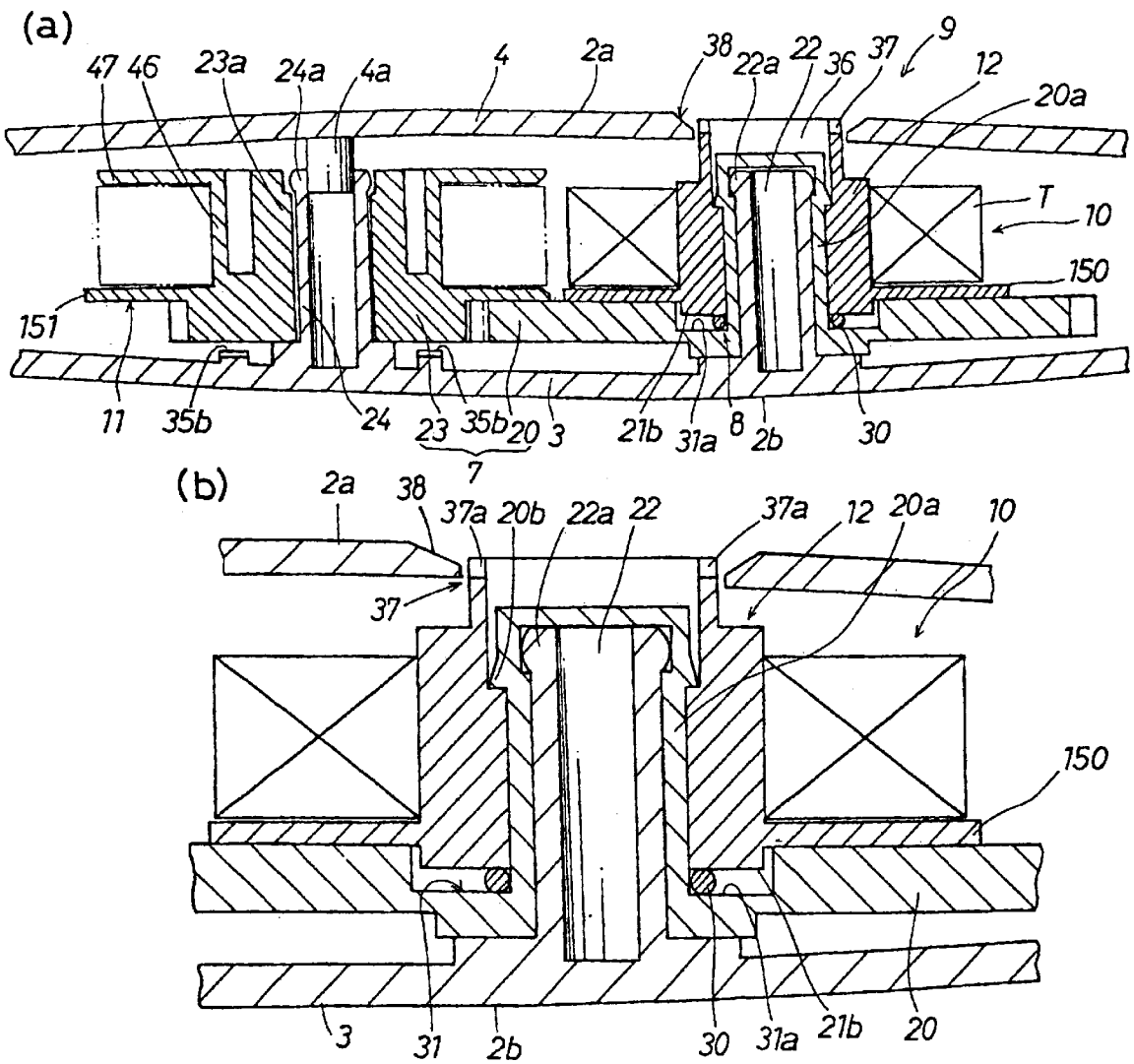
FIG. 16(*a*) is a longitudinal sectional view showing a disposable type coat film transfer tool in embodiment 10 of the invention.

This embodiment is shown in FIG. 16, relating to a disposable type for discarding the coat film transfer tape T when used up, as compared with the refill type illustrated in embodiments 1 to 9.

That is, in the coat film transfer tool of the embodiment, the feed reel 10 and take-up reel 10 are rotatably provided in the case 2 respectively, and these reels 10, 11 are provided with automatic winding mechanism.

More specifically, in the foregoing embodiments, the tape winding portion 12 of the feed reel 10 was separated into the driven member 21 and drum 45, whereas they are formed integrally in this embodiment, and the tape winding portion 12 is rotatably provided on the rotary shaft 20*a* of the drive side rotary gear 20. At the support end side of the tape winding portion 12, a tape running guide flange 150 is integrally provided. This guide flange 150 is designed to slide on the upper surface of the drive side rotary gear 20, and functions as a position defining unit for suppressing the distance between both engaging planes 31*a*, 21*b* of the clutch mechanism 8 within a set value.

On the other hand, the drum 46 of the take-up reel 11 and rotary shaft 23*a* of the follower side rotary gear 23, which were in separate structure in the foregoing embodiments, are integrated in the embodiment, and the take-up reel 11 and follower side rotary gear 23 are formed integrally. At the support end side of the take-up reel 11, a tape running guide flange 151 is also formed integrally, and this guide flange 151 is designed to slide on the upper surface of the drive side rotary gear 20.

Although not shown, the coat film transfer head X may be provided either rotatably about the axial center or stationarily, at the cylindrical leading end 50 of the case 2. The mounting angle of the coat film transfer head H in the rotating direction may be variable depending on the purpose, that is, in the lateral pulling position as shown in FIG. 1 and FIG. 7 in the case of the coat film transfer tool 1 for lateral pulling use, or in the vertical pulling position, orthogonal to the lateral pulling position, in the case of coat film transfer tool 1 for vertical pulling use.

The other construction and action are same in embodiment 1.

Embodiment 11

Figure 17:
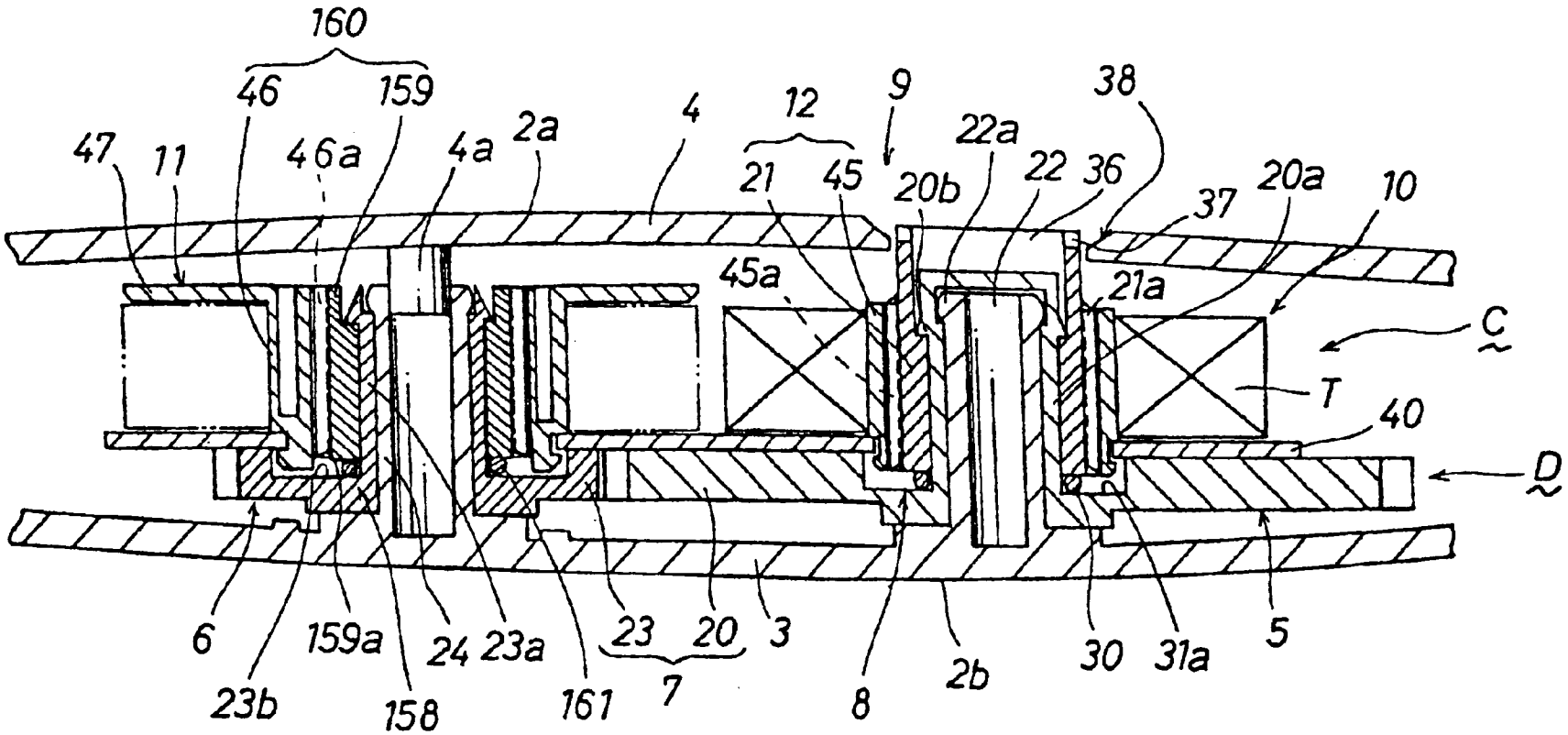
FIG. 17 is a longitudinal sectional view showing a refill type coat film transfer tool in embodiment 11 of the invention.
Figure 18:
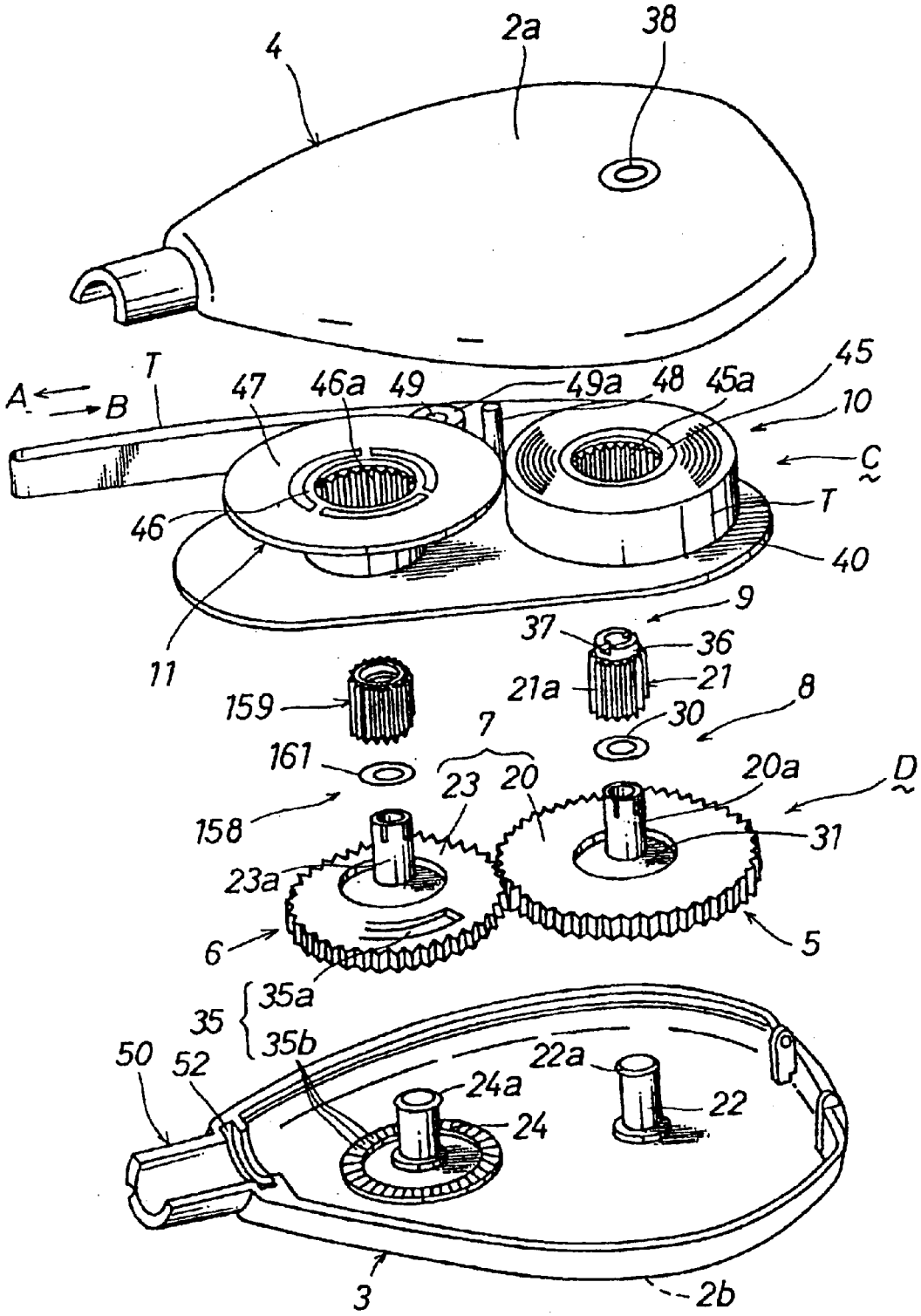
FIG. 18 is a perspective exploded view of the coat film transfer tool.

This embodiment is shown in FIG. 17 and FIG. 18, relating to a double clutch type installing another clutch mechanism 158 at the take-up rotary unit 6, in the constitution of the coat film transfer tool of embodiment 1.

The specific construction of this clutch mechanism 158 is same as that of the clutch mechanism 8 of the feed rotary unit 5. That is, a driven member 159 is interposed between the rotary shaft 23*a* of the follower side rotary gear 23 and the drum 46 of the take-up reel 11, and a tape winding portion 160 of the take-up reel 11 is composed by this driven member 159 and drum 46. The mutual coupling structure of the rotary shaft 23*a*, driven member 159 and drum 46 is same as in the clutch mechanism 8, and an O-ring 161 is interposed as friction member between the engaging planes 159*a*, 23*b* of the driven member 159 and follower side rotary gear 23. The other specific construction corresponds to the clutch mechanism 8.

In the constitution of such double clutch type, action of excessive tension on the coat film transfer tape T during rewinding operation by the tape rewinding mechanism 9 can be effectively prevented.

That is, as mentioned above, when operated to rewind by the tape rewinding mechanism 9, the drum 45 rotates in the rewinding direction, and the drum 46 is in stopped state by the action of the reverse rotation preventive mechanism 35, so that the slack of the coat film transfer tape T between the both reels 10, 11 is eliminated and removed.

In this case, if rewinding operation is continued after the slack of the coat film transfer tape T is eliminated and removed due to wrong operation or the like, this time, to the contrary, an excessive tension acts on the coat film transfer tape T. If such status should occur, by the action of the clutch mechanism 158, the tape winding portion 160 slides and rotates on the follower side rotary gear 23, so that breakage of the coat film transfer tape T can be prevented.

The other construction and action are same in embodiment 1.

Embodiment 12

Figure 19:
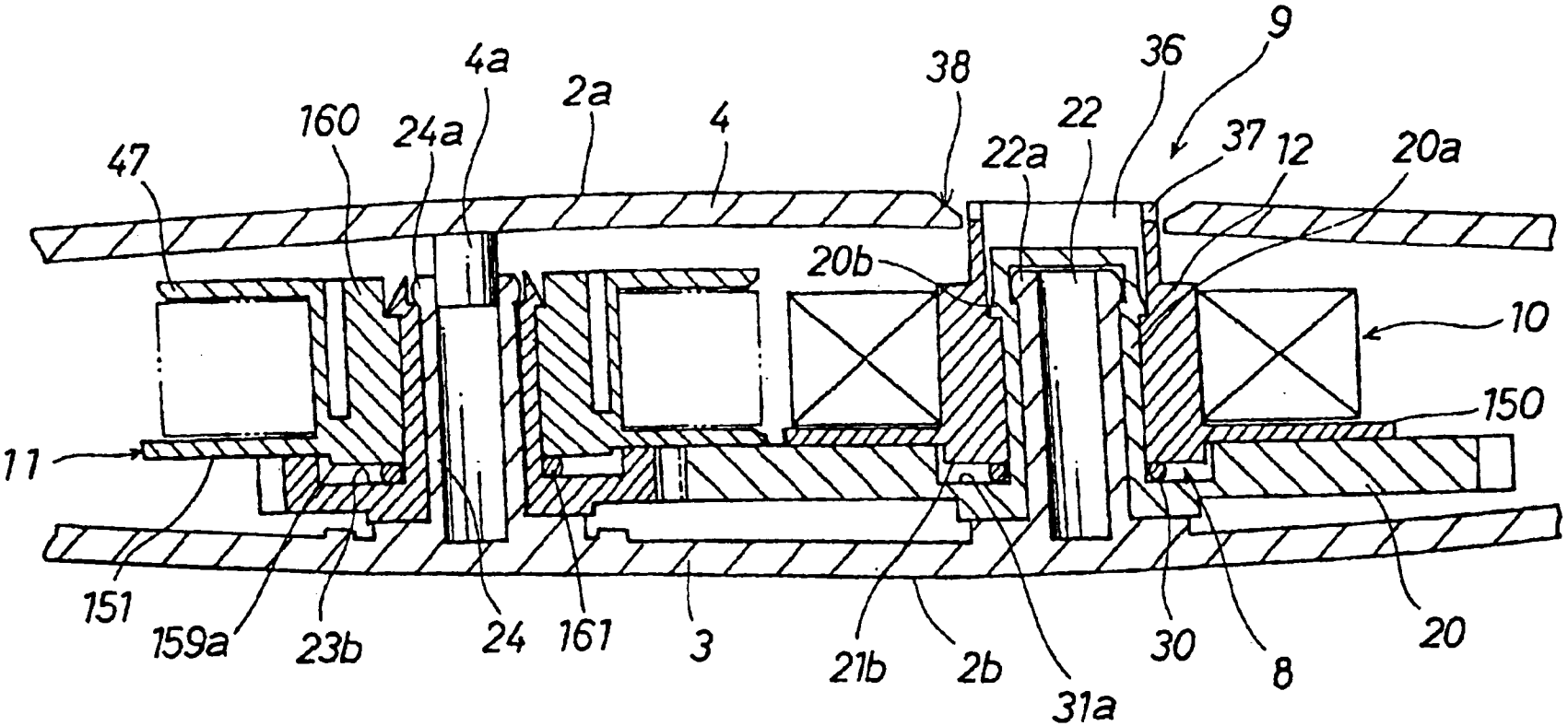
FIG. 19 is a longitudinal sectional view showing a disposable type coat film transfer tool in embodiment 12 of the invention.

This embodiment is shown in FIG. 19, and the double clutch structure of refill type in embodiment 11 is modified to the disposable type as in embodiment 10.

That is, in the coat film transfer tool of the embodiment, the construction of the feed reel 10 side is exactly same as in the construction of embodiment 10 (see FIG. 16). On the other hand, a tape winding portion 160 of the take-up reel 11 is integrated as shown, and the tape winding portion 160 is rotatably provided on the rotary shaft 23*a* of the follower side rotary gear 23. At the support end side of the tape winding portion 160, a tape running guide flange 151 is integrally provided. This guide flange 151 slides on the upper surfaces of the follower side rotary gear 23, and function as a position defining unit for suppressing the distance between two engaging planes 159*a*, 23*b* of the clutch mechanism 158 within a set value.

Although not show, the construction of the coat film transfer head H is same as in embodiment 10, and other construction and action are same in embodiment 11.

In the foregoing embodiments 1 to 12, the following modifications are also possible.

(1) The clutch mechanism in embodiments 2 to 9 can be also applied to the coat film transfer tool of the disposable type as in embodiment 10.

(2) In embodiments 1 to 10, the clutch mechanism is disposed at the feed reel 10 side, but it may be also disposed at the take-up reel 11 side depending on the purpose.

(3) As the friction member of the clutch mechanism in embodiments 1 to 3, leaf spring, belleville spring, other spring member, and various washers having elasticity in the thrust direction may be used.

(4) The specific structure of the first and second engaging portions of the clutch mechanism in embodiments 4 to 9 is not limited to the illustrated embodiments alone, but other structures having similar function may be employed.

(5) As the coat film transfer tape T, by using the structure forming an adhesive agent on one side of a base film through a releasing agent layer, the coat film transfer tool may be used as an applicator for transferring only the adhesive agent layer on the paper.

(6) The specific structure of the rewinding operation unit and the driven member formed integrally therewith is not limited to the illustrated embodiments alone, but other structures that can be easily manipulated from outside of the case 2 may be employed.

For example, in the illustrated embodiments, the driven member 21 or tape winding portion 12 is in a hollow cylindrical form, and rewinding operation units 37, 57 are provided in the hollow edge, but the free end of the driven member 21 or tape rewinding portion 12 may be closed, and the rewinding operation units 37, 57 may be provided at this closed end. In this case, by the closed end of the driven member 21 or tape winding portion 12, the rotary shaft 20*a* and hollow support shaft 22 are concealed from outside, so that a simple appearance may be presented.

Figure 20:
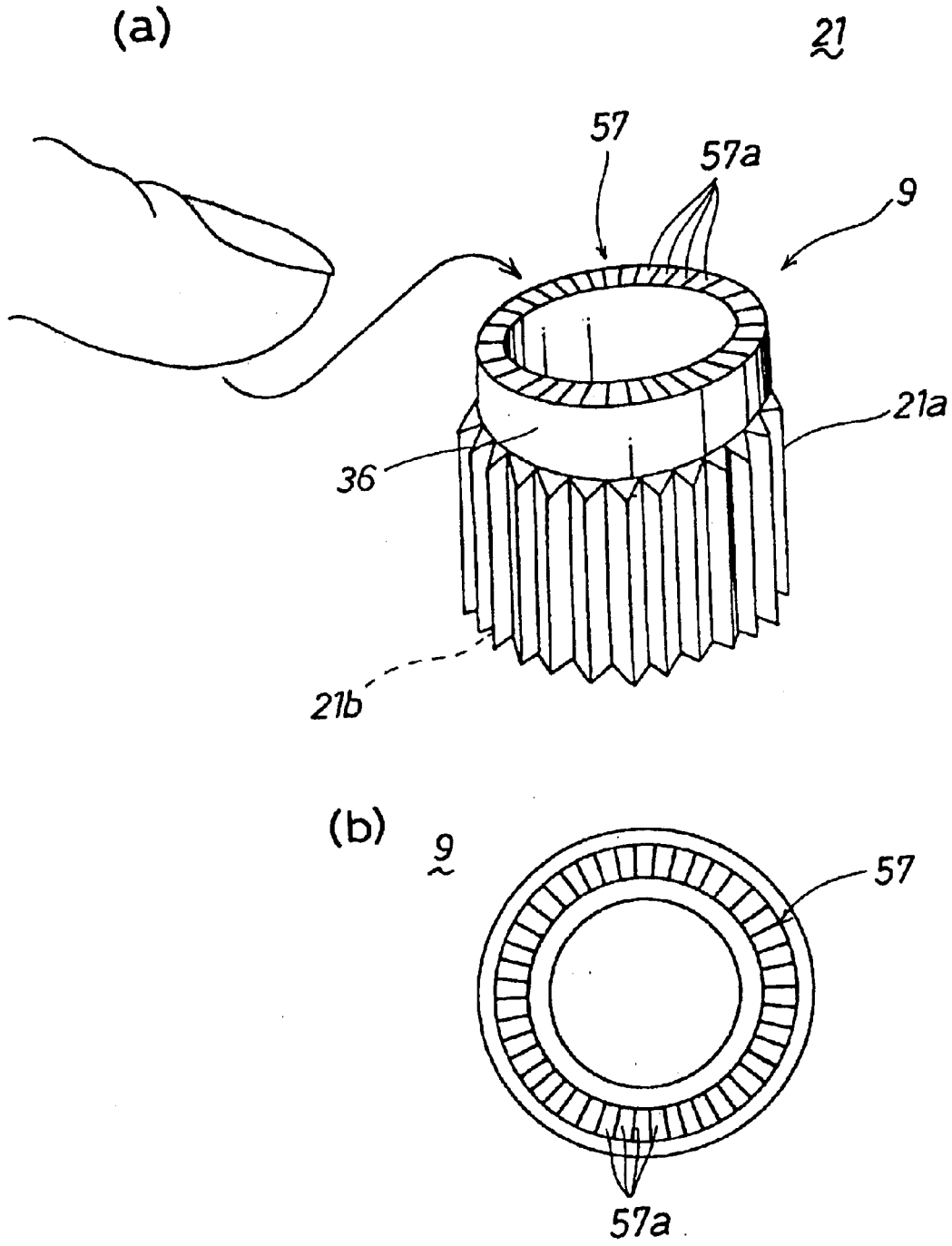
FIG. 20(*a*) is a perspective view corresponding to FIG. 6(*a*) showing a modified example of rewinding operation unit in the tape drive unit.
Figure 21:
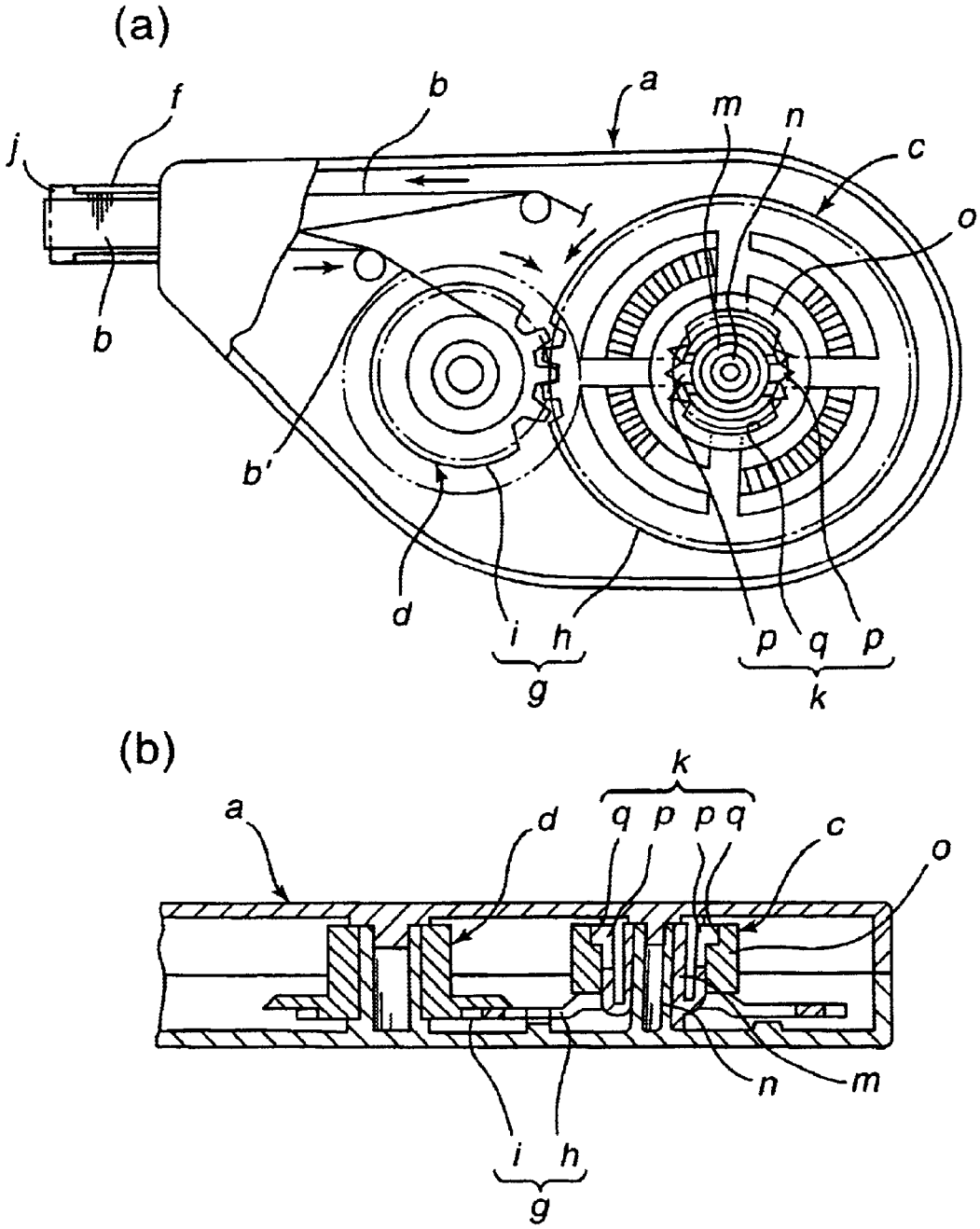
FIG.21 PRIOR ART
FIG. 21(*a*) is a partially cut-away perspective view of a conventional coat film transfer tool.

Alternatively, the rewinding operation unit 57 as shown in FIG. 20 may be employed. That is, the rewinding operation unit 57 has an anti-skid shape that can be manipulated by finger or the like, and specifically it is composed of anti-skid undulations 57*a*, 57*a*, . . . such as tread pattern.

As described herein, according to the invention, the clutch mechanism for synchronizing the feed speed and take-up speed of the coat film transfer tape at the feed reel and take-up reel composes the power transmission unit between the tape winding portion for winding the coat film transfer tape and the rotary drive unit for rotating and driving the tape winding portion, at least in one of the both reels, and the power transmission of this power transmission unit makes use of the frictional force due to thrust load between the tape winding portion and the rotary drive unit, and therefore each constituent member slides smoothly and relatively in synchronizing action, and the sense of manipulation is excellent and uneven running does not occur.

Figure 22:
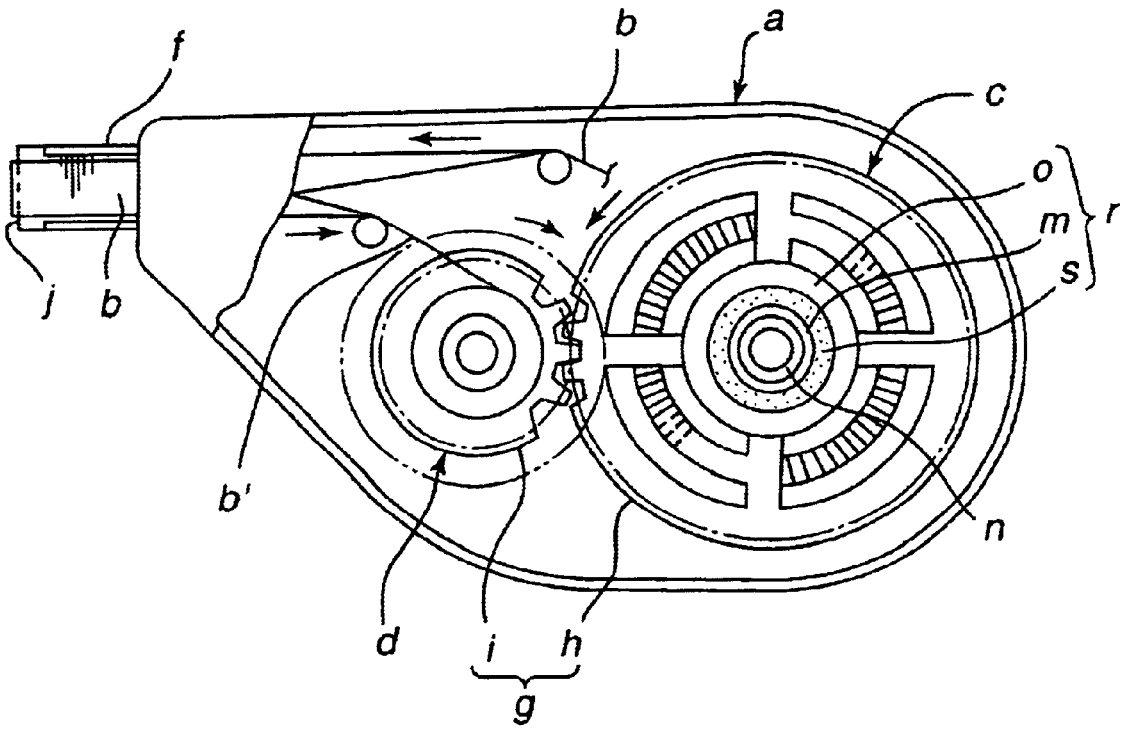
FIG.22 PRIOR ART
FIG. 22(*a*) is a partially cut-away perspective view of other conventional coat film transfer tool.
Figure 22:
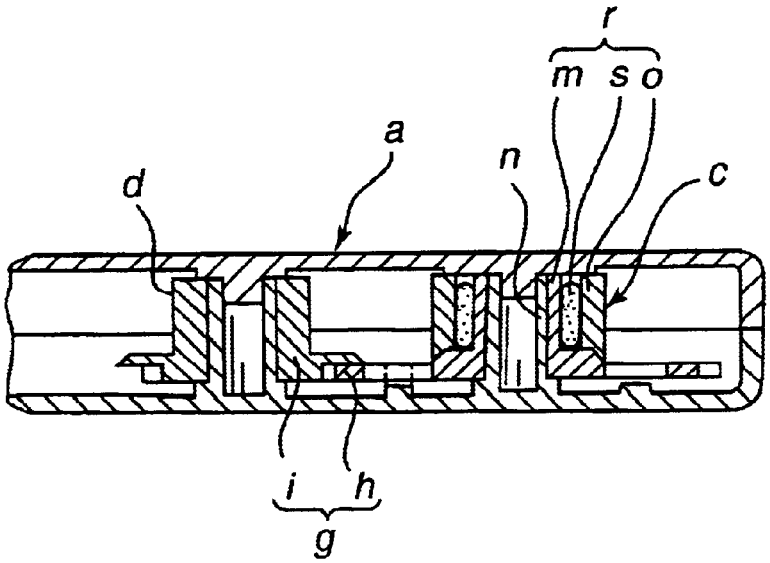
FIG.22 PRIOR ART

The construction of the clutch mechanism may be determined by properly adjusting the dimensional relation in the thrust direction among mutual constituent members, and the frictional force may be set to an optimum value, and as compared with the conventional structure making use of frictional force due to radial load (see FIG. 22), the designing and manufacturing conditions of constituent members are less strict and the manufacture is easy, assembling is easy, and hence the manufacturing cost and device cost may be also lowered.

In the coat film transfer tool having a tape rewinding mechanism, when the clutch mechanism is provided also in take-up reel as well as in the feed reel, in rewinding operation by the tape rewinding mechanism, action of excessive tension on the coat transfer tape can be effectively prevented.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A clutch mechanism of coat film transfer tool, comprising:

a feed reel with a coat film transfer tape wound thereabout and a take-up reel for collecting the coat film transfer tape after use, the take-up reel cooperating with the feed reel in a case to synchronize a feed speed and take-up speed of the coat film transfer tape in both reels, power transmission means is provided between a tape winding portion for winding up the coat film transfer tape and a rotary drive unit for rotating and driving the tape winding portion, the power transmission means is composed in at least one of the feed and take-up reels that engages the tape winding portion for rotation therewith, and the rotary drive unit including a rotary drive shaft having catch means at one end of the rotary drive shaft and an engaging portion formed at an opposite end of the rotary drive shaft and extending radially outwardly therefrom and the tape winding portion including a tape winding portion shaft disposed concentrically about the rotary drive shaft for rotation thereabout and having catch receiving means at one end of the tape winding portion shaft for engaging with the catch means and an engaging portion formed at an opposite end of the tape winding portion shaft and defining an annulus end of the tape winding portion shaft, the engaging portions disposed in a facially opposing relationship for frictional and compressing engagement between each other causing a thrust load to the catch means and the catch receiving means, when engaged, thereby preventing relative axial movement between the rotary drive unit and the tape winding portion while affording simultaneous rotational movement of the rotary drive unit and the tare winding portion unless a rotational force to cause rotational movement exceeds a frictional force between the engaging portions.

2. A clutch mechanism of coat film transfer tool of claim 1, wherein the power transmission means is composed of a first engaging portion formed on an axial end surface of the tape winding portion, and a second engaging portion formed on an axial end surface of the rotary drive unit, these engaging portions are composed of plural annular ribs provided concentrically with the tape winding portion and rotary drive unit, and these annular ribs have an angle section formed of a pair of slopes, and the annular ribs of the first and second engaging portions frictionally mutually contact on the slopes.

3. A clutch mechanism of coat film transfer tool of claim 1, wherein the power transmission means is composed of a first engaging portion formed on an axial end surface of the tape winding portion, and a second engaging portion formed on an axial end surface of the rotary drive unit, one of first and second engaging portions is formed on a flat plane, and the other of the first and second engaging portions is composed of plural annular ribs, and the flat plane and leading ends of the annular ribs frictionally contact with each other.

4. A clutch mechanism of coat film transfer tool of claim 1, wherein the power transmission means is composed of a first engaging portion formed on an axial end surface of the tape winding portion, and a second engaging portion formed on an axial end surface of the rotary drive unit, one of the first and second engaging portions is formed on a flat plane, and the other of the first and second engaging portions is composed of multiple radial ribs formed at equal intervals in a circumferential direction, and the flat plane and leading ends of the radial ribs frictionally contact with each other.

5. A clutch mechanism of coat film transfer tool of claim 1, wherein the power transmission means is composed of a first engaging portion formed on an axial end surface of the tape winding portion, and a second engaging portion formed on an axial end surface of the rotary drive unit, the first engaging portion is formed on a flat plane, and the second engaging portion is composed of plural engaging protrusions having elasticity in the axial direction, the plural engaging protrusions formed at equal intervals in the circumferential direction, and the flat plane and leading ends of the radial ribs frictionally contact with each other.

6. A clutch mechanism of coat film transfer tool of claim 1, wherein the power transmission means is composed of a first engaging portion formed on an axial end surface of the tape winding portion, and a second engaging portion formed on an axial end surface of the rotary drive unit, the first engaging portion is composed of plural engaging protrusions having elasticity in the axial direction, the plural engaging protrusions formed at equal intervals in the circumferential direction, and the second engaging portion is formed on a flat plane, and leading ends of engaging protrusions and the flat plane frictionally contact with each other.

7. A clutch mechanism of coat film transfer tool of claim 1, wherein the power transmission means is composed of a first engaging portion formed on an axial end surface of the tape winding portion, and a second engaging portion formed on an axial end surface of the rotary drive unit, the first engaging portion is an annular engaging flange having elasticity in the axial direction, and the second engaging portion is formed on a flat plane, and leading ends of the engaging flange and the flat plane frictionally contact with each other.

8. A clutch mechanism of coat film transfer tool of claim 1, wherein a position defining unit is provided for suppressing distance between axial end surfaces of the tape winding portion and the rotary drive unit within a set value.

9. A coat film transfer tool using a coat film transfer tape of disposable type, comprising:

a case having shape and dimensions to be held and manipulated by one hand, a feed reel rotatably provided in the case and winding a coat film transfer tape, a take-up reel rotatably provided in the case and collecting the coat film transfer tape after use, an interlock means for linking said feed and take-up reels so as to cooperate with each other, and a coat film transfer head protruding at a front end of the case and pressing the coat film transfer tape onto an object of transfer, a clutch means for synchronizing, at least in one of the feed and take-up reels, a feed speed and take-up speed of the coat film transfer tape between the feed and take-up reels, wherein the clutch means composes, at least in one of the feed and take-up reels, power transmission means provided between a tape winding portion for winding up the coat film transfer tape and a rotary drive unit for rotating and driving the tape winding portion, and the rotary drive unit including a rotary drive shaft having catch means at one end of the rotary drive shaft and an engaging portion formed at an opposite end of the rotary drive shaft and extending radially outwardly therefrom and the tape winding portion including a tape winding portion shaft disposed concentrically about the rotary drive shaft for rotation thereabout and having catch receiving means at one end of the tape winding portion shaft for engaging with the catch means and an engaging portion formed at an opposite end of the tape winding portion shaft and defining an annulus end of the tape winding portion shaft, the engaging portions disposed in a facially opposing relationship for frictional and compressing engagement between each other causing a thrust load to the catch means and the catch receiving means, when engaged, thereby preventing relative axial movement between the rotary drive unit and the tape winding portion while affording simultaneous rotational movement of the rotary drive unit and the tape winding portion unless a rotational force to cause rotational movement exceeds a frictional force between the engaging Portions.

10. A coat film transfer tool of claim 9, further comprising:

a tape rewinding mechanism for eliminating and removing slack of the coat film transfer tape between the two reels, wherein the tape rewinding mechanism has an axial free end of the tape winding portion for winding the coat film transfer tape provided oppositely to the outside of the case in the feed reel, and a rewinding operation unit is integrally formed at the end surface of said free end.

11. A coat film transfer tool of claim 10, wherein the clutch means is provided in both the feed reel and take-up reel.

12. A coat film transfer tool using a coat film transfer tape of refill type, comprising:

a case having shape and dimensions to be held and manipulated by one hand, a feed rotary unit rotatably provided in the case, a take-up rotary unit rotatably provided in the case, an interlock means for linking the feed and take-up rotary units so as to cooperate with each other, a tape cartridge having a feed reel and a take-up reel engaged detachably and rotatably with both the feed and take-up rotary units respectively, and a coat film transfer head protruding at a front end of the case and pressing the coat film transfer tape onto an object of transfer, a clutch means for synchronizing, in at least one of the feed and take-up rotary units, a feed speed and take-up speed of the coat film transfer tape in the feed and take-up rotary units, wherein the clutch means composes, at least in one of the feed and take-up rotary units, power transmission means provided between a tape winding portion for winding up the coat film transfer tape and a rotary drive unit for rotating and driving the tape winding portion, and the rotary drive unit including a rotary drive shaft having catch means at one end of the rotary drive shaft and an engaging portion formed at an opposite end of the rotary drive shaft and extending radially outwardly therefrom and the tare winding portion including a tape winding portion shaft disposed concentrically about the rotary drive shaft for rotation thereabout and having catch receiving means at one end of the tape winding portion shaft for engaging with the catch means and an engaging portion formed at an opposite end of the tape winding portion shaft and defining an annulus end of the tape winding portion shaft, the engaging portions disposed in a facially opposing relationship for frictional and compressing engagement between each other causing a thrust load to the catch means and the catch receiving means, when engaged, thereby preventing relative axial movement between the rotary drive unit and the tape winding portion while affording simultaneous rotational movement of the rotary drive unit and the tape winding portion unless a rotational force to cause rotational movement exceeds a frictional force between the engaging portions.

13. A coat film transfer tool of claim 12, further comprising:

a tape rewinding mechanism for eliminating and removing slack of the coat film transfer tape between the two reels, wherein the tape rewinding mechanism has an axial free end of the tape winding portion for winding the coat film transfer tape provided oppositely to the outside of the case in the feed reel, and a rewinding operation unit is integrally formed at the end surface of said free end.

14. A coat film transfer tool of claim 12, wherein the clutch means is provided in both the feed rotary unit and take-up rotary unit.

* * * * *